US006104422A

United States Patent [19]

Kuboyama et al.

[11] Patent Number: 6,104,422

[45] Date of Patent: Aug. 15, 2000

[54] SUBLIMATION THERMAL IMAGE TRANSFER RECORDING METHOD AND IMAGE RECEIVING SHEET THEREFOR

[75] Inventors: Hiroki Kuboyama; Hidehiro Mochizuki; Makoto Sekiyama; Shinya Kawahara, all of Shizuoka, Japan

[73] Assignee: Ricoh Company, Ltd., Tokyo, Japan

[21] Appl. No.: 08/966,488

[22] Filed: Nov. 7, 1997

[30] Foreign Application Priority Data

| | | | |
|---|---|---|---|
| Nov. 7, 1996 | [JP] | Japan | 8-311380 |
| Apr. 16, 1997 | [JP] | Japan | 9-114448 |
| Nov. 6, 1997 | [JP] | Japan | 9-320471 |

[51] Int. Cl.[7] ..... B41M 5/38; B41J 2/325

[52] U.S. Cl. ..... 347/212; 347/221; 503/227

[58] Field of Search ..... 347/171, 212, 347/221; 503/227; 400/120.18

[56] References Cited

U.S. PATENT DOCUMENTS

| | | | |
|---|---|---|---|
| 4,666,320 | 5/1987 | Kobyashi et al. | 347/212 |
| 4,716,145 | 12/1987 | Vanier et al. | 347/212 |
| 4,775,657 | 10/1988 | Harrison et al. | 503/227 |
| 5,011,815 | 4/1991 | Beck et al. | 347/212 |
| 5,356,859 | 10/1994 | Lum et al. | 503/227 |
| 5,474,969 | 12/1995 | Hastreiter, Jr. et al. | 503/227 |
| 5,488,025 | 1/1996 | Martin et al. | 503/227 |

*Primary Examiner*—Haun Tran
*Attorney, Agent, or Firm*—Cooper & Dunham LLP

[57] ABSTRACT

A sublimation thermal image transfer recording method for thermally forming images on an image receiving sheet prepared by forming a dye-receiving layer on a substrate, includes the steps of superimposing a sublimation thermal image transfer recording sheet which has a substrate and at least one recording layer formed thereon containing a sublimable dye, on the image receiving sheet in such a manner that the recording layer of the recording sheet comes into contact with the dye-receiving layer of the image receiving sheet, recording images on the dye-receiving layer of the image receiving sheet by applying thermal energy Ei image-wise to the recording sheet from the substrate side thereof using a thermal head, and subjecting the image-bearing image receiving sheet to heat treatment by applying thermal energy Eb to the image receiving sheet using the thermal head through a sheet member for heat treatment, the thermal energy Eb being smaller than the thermal energy Ei. In the image receiving sheet, an overcoat layer may be formed on the dye-receiving layer, the overcoat layer having a dynamic friction coefficient of less than 0.45 which is measured in accordance with ASTM-01894 and containing a silicone resin and a lubricant.

24 Claims, No Drawings

SUBLIMATION THERMAL IMAGE TRANSFER RECORDING METHOD AND IMAGE RECEIVING SHEET THEREFOR

BACKGROUND OF THE INVENTION

1. Field of the Invention

The present invention relates to a sublimation thermal image transfer recording method, and an image receiving sheet for use with the above-mentioned recording method.

2. Discussion of Background

Recently the demand for full color printers is increasing year by year. Representative examples of the recording methods for full color printers now available include the electrophotographic method, ink-jet method, and thermal image transfer recording method. Of these methods, special attention has been paid to the thermal image transfer recording method because of its advantages over the other methods in that the maintenance is easy and the operation is noiseless.

Depending on the kind of employed recording medium, the thermal image transfer recording method can be roughly classified into two types, (i) a thermal fusing image transfer type and (ii) a sublimation thermal image transfer type.

The above-mentioned thermal fusing image transfer recording method (i) is carried out using a thermal image transfer recording medium, namely, an ink sheet, comprising an image transfer layer which comprises a thermofusible material and a coloring agent dispersed therein and an image receiving sheet. The thermal image transfer recording sheet is superimposed on the image receiving sheet in such a manner that the image transfer layer comes into contact with an image-receiving layer of the image receiving sheet, and thermal energy is imagewise applied to the side of the thermal image transfer recording sheet using a laser beam or thermal head, whereby the coloring agent contained in the thermal image transfer recording sheet is fused and transferred to the image receiving sheet.

A sublimation thermal image transfer recording sheet used in the sublimation thermal image transfer recording method (ii) comprises an image transfer layer (namely, a recording layer) which contains a thermally sublimable dye or thermally transferrable dye. When the recording sheet is superimposed on an image receiving layer of the image receiving sheet and thermal energy is imagewise applied to the sublimation thermal image transfer recording sheet, the sublimable dye or transferrable dye can be sublimated or transferred to the image receiving sheet, thereby performing sublimation thermal image transfer recording.

To produce a full-color image, the sublimation thermal image transfer recording method (ii) is generally considered to be advantageous over the thermal fusing image transfer recording method (i) in that color tone can be faithfully reproduced.

In the above-mentioned sublimation thermal image transfer recording method (ii), the sublimation thermal image transfer recording sheet is repeatedly used for image recording in order to curtail the running cost of the image recording. Farther, there has been proposed a so-called n-times-speed mode. In the n-times-speed mode, the transporting speed of the image receiving sheet is made n (n>1) times the transporting speed of the sublimation thermal image transfer recording sheet.

The conventional image receiving sheet for use with the sublimation thermal image transfer recording is still unsatisfactory because preservation stability of the recorded image is poor and durability of the recorded image, such as the light resistance, plasticizer resistance, fingerprint resistance and friction resistance of the recorded image is insufficient. In particular, when the image recorded on the image receiving sheet is allowed to stand at high temperature or exposed to sunlight for a long period of time, the image quality and the image density are easily decreased.

Recently, it has been proposed to prepare a driving license card and a variety of identification cards by the sublimation thermal image transfer recording method. In such a case, the information recorded in the cards must be maintained without deterioration for an extended period of time, so that high durability is required with respect to the recorded image.

There are proposed various methods to solve the above-mentioned problems. For preventing the actions of a the light and oxygen which have an adverse effect on the images recorded on the image receiving sheet, for example, it is proposed that a transparent resin film comprising photo-deterioration inhibitors such as an ultraviolet absorber and an antioxidant is attached to the image-bearing image receiving sheet via an adhesive layer. The images can be shielded from the light and oxygen by such a laminated image receiving sheet, so that the durability of the recorded image is improved to some extent in terms of the light resistance. However, the process for preparing the image-bearing image receiving sheet becomes complicated, and the cost is increased because a laminating machine becomes necessary. In addition, the dye contained in the recorded image tends to transfer to the above-mentioned adhesive layer, thereby causing the image blurring.

There are many proposals for improving the stability of recorded images in terms of light resistance and plasticizer resistance, as disclosed in Japanese Patent Publication 4-55870, and Japanese Laid-Open Patent Applications 4-284291 and 9-66678. According to those applications, after an image comprising a sublimable dye is formed on a single or laminated dye-receiving layer of the image receiving sheet by the application of heat thereto, the image-bearing sheet is heated again using, for example, a thermal head, so as to diffuse the sublimable dye present at the surface portion of the dye-receiving layer into the inside thereof. By this method, good results can be obtained with respect to the preservation stability of the recorded images in terms of the light resistance and plasticizer resistance.

However, even though the image-bearing image receiving sheet is subjected to heat treatment through a sheet member, for example, a sublimable-dye-free area of the recording sheet, the sublimable-dye-free area of the recording sheet is made rough. This is because the thermal head applies the thermal energy of high temperature to the sublimable-dye-free area of the recording sheet as scanning thereon. Further, the glossiness of the image recorded on the image receiving sheet is decreased because the image receiving sheet is scorched by the heat treatment, and the image receiving sheet tends to be curled by the application of heat thereto.

The conventional image receiving sheet for use with the sublimation thermal image transfer recording method comprises a support and a dye-receiving layer formed thereon, comprising a thermoplastic resin with high dyeability with respect to the sublimable dye, such as a polyester resin. Such a conventional image receiving sheet tends to be fused and stick to the thermal image transfer recording sheet in the course of image recording under the application of heat. In particular, when the sublimation thermal image transfer recording is carried out by the n-times-speed mode, the image receiving sheet tends to easily adhere to the recording sheet or to be broken because strong friction is generated between the image receiving sheet and the thermal image transfer recording sheet. Therefore, the image receiving sheet is required to have high heat resistance and lubricity when used in the n-times-speed mode, as compared with the so-called equal-speed mode in which the image receiving sheet and the thermal image transfer recording sheet are transported at equal speed to achieve the image transfer recording.

SUMMARY OF THE INVENTION

Accordingly, a first object of the present invention is to provide a sublimation thermal image transfer recording method comprising the step of subjecting the image-bearing image receiving sheet to heat treatment through a sheet member for heat treatment or a sublimable-dye-free portion of the sublimation thermal image transfer recording sheet, which recording method is capable of improving the preservation stability of the recorded image in terms of the light resistance and the plasticizer resistance, without scorching the image receiving sheet, decreasing the image glossiness, and damaging the sheet member for heat treatment.

A second object of the present invention is to provide an image receiving sheet capable of forming normal images thereon by the sublimation thermal image transfer recording method, in particular in the n-times-speed mode, without sticking to the sublimation thermal image transfer recording sheet and being broken in the course of image transfer recording.

The first object of the present invention can be achieved by a sublimation thermal image transfer recording method for thermally forming images on an image receiving sheet which comprises a substrate and a dye-receiving layer formed thereon, using a sublimation thermal image transfer recording sheet comprising a substrate and at least one recording layer provided thereon, comprising a sublimable-dye-containing ink area. This sublimation thermal image transfer recording method comprises the steps of superimposing the sublimation thermal image transfer recording sheet on the image receiving sheet in such a manner that the recording layer of the recording sheet comes into contact with the dye-receiving layer of the image receiving sheet, recording images on the dye-receiving layer of the image receiving sheet by applying thermal energy Ei imagewise to the sublimation thermal image transfer recording sheet from the side of the substrate thereof using a thermal head, thereby forming an image-bearing image receiving sheet, and subjecting the image-bearing image receiving sheet to heat treatment by applying thermal energy Eb to the dye-receiving layer of the image receiving sheet using the thermal head, through a sheet member for heat treatment, the thermal energy Eb being smaller than the thermal energy Ei for image transfer recording.

The second object of the present invention can be achieved by an image receiving sheet for use with sublimation thermal image transfer recording, comprising a substrate, a dye-receiving layer formed on the substrate, and an overcoat layer formed on the dye-receiving layer, the overcoat layer having a coefficient of dynamic friction of less than 0.45 which is measured in accordance with ASTM-D1894 and comprising a silicone resin and a lubricant.

DESCRIPTION OF THE PREFERRED EMBODIMENTS

By the sublimation thermal image transfer recording method, a sublimable dye image is transferred from the recording layer of a sublimable thermal image transfer recording sheet to the dye-receiving layer of an image receiving sheet, thereby performing image transfer recording. In this case, the sublimable dye constituting a dye image recorded on the image receiving sheet is almost present in the surface portion of the dye-receiving layer of the image receiving sheet, so that image quality of the dye image readily deteriorates for a long period of storage.

According to the present invention, the sublimable dye existing in the surface portion of the image receiving sheet is caused to move into the inside of the dye-receiving layer by subjecting the image-bearing image receiving sheet to heat treatment using a thermal head. Therefore, the preservation stability of the recorded image, and the plasticizer resistance and the light resistance of the recorded image can be improved.

The sublimation thermal image transfer recording method of the present invention comprises the steps of:

superimposing (a) a sublimation thermal image transfer recording sheet comprising a substrate and at least one recording layer provided on the substrate, comprising an ink area which comprises a sublimable dye, on (b) the image receiving sheet, in such a manner that the recording layer of the sublimation thermal image transfer recording sheet comes into contact with the dye-receiving layer of the image receiving sheet, recording images on the dye-receiving layer of the image receiving sheet by applying thermal energy Ei imagewise to the sublimation thermal image transfer recording sheet from the substrate side of the recording sheet using a thermal head, thereby forming an image-bearing image receiving sheet, and subjecting the image-bearing image receiving sheet to heat treatment by applying thermal energy Eb to the dye-receiving layer of the image receiving sheet using the thermal head, through a sheet member for heat treatment, the thermal energy Eb for heat treatment being smaller than the thermal energy Ei for image transfer recording.

It is preferable that the above-mentioned thermal energy Ei for image transfer recording and thermal energy Eb for heat treatment be in the relationship of $Ei>Eb>0.8\ Ei$.

If $Ei<Eb$, the thermal head used for the heat treatment will become fatigued, thereby reducing the life of the thermal head. This is because the heat treatment is carried out in such a manner that high thermal energy is uniformly applied to the whole image recorded area. At the same time, the surface of the dye-receiving layer will be scorched when the maximum thermal energy is applied to the image receiving sheet for heat treatment. As a result, the glossiness of the recorded image is abnormally decreased, and the image quality is thus lowered. Further, the surface of the sheet member for heat treatment, through which the thermal energy is applied to the image-bearing image receiving sheet, is made rough, and the image receiving sheet is easily curled, by the application of a large quantity of thermal energy during the heat treatment.

On the other hand, when the thermal energy Eb for heat treatment is less than 80% of the thermal energy Ei for image transfer recording, the sublimable dye constituting a dye image formed on the surface of the dye-receiving layer of the image receiving sheet cannot be sufficiently moved into the inside of the dye-receiving layer by the heat treatment. Therefore, the preservation stability and the light resistance of the recorded image cannot be effectively improved.

In the present invention, when the sublimation thermal image transfer recording is carried out by the n-times-speed mode, it is preferable that the heat treatment after image recording be also carried out by the n-times-speed mode in light of the running cost. In this case, it is desirable that the recording layer of the sublimation thermal image transfer recording sheet comprise an ink area comprising a sublimable dye and an area free of the sublimable dye which is used as the sheet member for heat treatment, and that the sublimable-dye-free area have a length b and the ink area have a length i in the transporting direction of the sublimation thermal image transfer recording sheet, with the lengths b and i being in the relationship of b<i.

In the above, when b=i, it means that the value of n in the n-times-speed mode in the sublimation thermal image transfer recording is equal to the value of n in the n-times-speed mode in the heat treatment.

As compared with the case where the heat treatment is carried out by the equal-speed mode, the glossiness of the image recorded on the image receiving sheet becomes better when the heat treatment is carried out by the n-times-speed mode. The reason for this is that the transporting speed of the recording sheet is relatively different from that of the image receiving sheet, so that the image-bearing surface of the image receiving sheet is made smooth and shiny by rubbing two sheets.

When b<i, it means that the value n in the n-times-speed mode in the heat treatment operation is smaller than that in the image transfer recording operation. In this case, the glossiness of the recorded image is further increased, and the running cost can be effectively decreased.

In the sublimation thermal image transfer recording method of the present invention, after the dye images are recorded on the image receiving sheet, a transparent film may be partially or entirely put on the image-bearing image receiving sheet and thus image-bearing image receiving sheet and the film may be laminated simultaneously with the previously mentioned heat treatment. Thus, a laminated image receiving sheet can be obtained. Alternatively, after laminating the image-bearing image receiving sheet and the transparent film, the heat treatment may be carried out.

In the previously mentioned sublimation thermal image transfer recording method of the present invention, the image receiving sheet may comprise a substrate and a dye-receiving layer formed thereon.

In order to increase the image density of the dye image recorded on the image receiving sheet, it is preferable that the dye-receiving layer of the image receiving sheet comprise a resin with high dyeability. For the dye-receiving layer, there can be used any conventional resins with high dyeability, such as polyester resin, vinyl chloride resin, acrylic resin, polyurethane resin, vinyl acetate resin and polyamide resin.

It is preferable that the thickness of the dye-receiving layer be in the range of about 1 to 20 $\mu$m, more preferably in the range of 1 to 10 $\mu$m.

The dye-receiving layer may further comprise a variety of conventional additives, such as a filler, a surfactant, an ultraviolet absorber, an antioxidant, and a fluorescent whitening agent when necessary. Such additives may be contained in the dye-receiving layer in an amount of 5 to 60 wt. % of the total weight of the dye-receiving layer.

Examples of the filler for use in the dye-receiving layer include white inorganic pigments such as silica, titanium oxide and calcium carbonate; and organic pigments such as fluoroplastics.

As the substrate for use in the image receiving sheet, a variety of papers, plastic films and rubber sheets are usable.

Examples of the paper serving as the substrate of the image receiving sheet include art paper, high quality paper, coated paper, gravure paper, baryta paper, cellulose fiber paper, wall paper, back paper, emulsion immersed-paper, synthetic rubber latex immersed-paper and synthetic-resin-internally-added paper.

As the plastic film, a sheet of synthetic paper or a film of polyolefin, polyvinyl chloride, polyethylene terephthalate, polystyrene, methacrylate or polycarbonate can be employed. Those may be used alone or laminated together.

In particular, a sheet of paper is preferable as the substrate of the image receiving sheet from the viewpoint of manufacturing cost. However, the convex and concave portions are easily formed on the surface of the paper when heat and pressure are applied to the image receiving sheet by the thermal head. The surface roughness of the substrate has an adverse effect on the image formation. Namely, the image quality of the image recorded on the dye-receiving layer will become uneven.

In light of the above problem caused by the substrate made of a sheet of paper, it is recommendable from the viewpoint of image quality that a cushioning layer be provided on a sheet of paper in such a configuration that the cushioning layer may be in contact with the dye-receiving layer. In this case, a sheet of paper and a cushioning layer may be laminated using a conventional adhesive or tackifier. Alternatively, a cushioning layer may be prepared by coating on a sheet of paper a liquid comprising microcapsules, each comprising a shell made of a resin such as polyvinylidene chloride or polyacrylonitrile, and a low boiling point solvent contained in the shell, such as butane or pentane, and heating the coating liquid when necessary to obtain a cushioning layer containing microspheres therein.

For the cushioning layer, there can be employed a film made of plastic materials such as polyester, polypropylene, vinyl chloride, polycarbonate, polyethylene or acetate, each comprising minute voids therein. A sheet with excellent cushioning properties, such as a rubber sheet can also be used as the cushioning layer.

In particular, a void-containing plastic film such as an expanded polyester film with heat insulating properties is preferable as the cushioning layer. When the cushioning layer is such a void-containing plastic film, it is preferable that the ratio of the density D of the void-containing plastic film to the density Do of a corresponding void-free plastic film be 0.7 or less. By using such a void-containing plastic film as the above-mentioned cushioning layer, images can be recorded on the image receiving sheet with high image density even by the application of a small amount of thermal energy. This effect is noticeable particularly when the image transfer recording is carried out by the n-times-speed mode.

It is preferable that the thickness of a substrate for use in the image receiving sheet, including a laminated member of a sheet of paper and a cushioning layer, be in the range of about 5 $\mu$m to 1 mm.

In the present invention, it is preferable that the image receiving sheet further comprise an overcoat layer which is provided on the dye-receiving layer in order to improve the heat resistance and the lubricity of the image receiving sheet.

The conventional dye-receiving layer of the image receiving sheet comprises, for example, (i) an uncrosslinked thermoplastic resin for improving the dyeability, and (ii) release agents such as a silicone oil and a silicone resin, when necessary, for preventing the sticking to the recording layer of the sublimation thermal image transfer recording sheet. Such release agents are essential for the anti-sticking performance with respect to the recording sheet in the equal-speed mode. However, the lubricity is not necessary for the image receiving sheet in the equal-speed mode. This is because when the lubricity is imparted to the surface portion of the image receiving sheet, the image receiving sheet tends to slip and fails to make proper contact with the recording layer of the recording sheet in the equal-speed mode, and therefore, the recording sheet readily becomes creased. As a result, the dye image cannot be partially transferred to the image receiving sheet.

In contrast to this, the sublimation thermal image transfer recording method of the present invention is intended to be carried out by the n-times-speed mode, so that the dye-receiving layer or overcoat layer of the image receiving sheet is required to be provided with sufficient heat resistance and lubricity.

In the n-times-speed mode, it is very important to improve the heat resistance of the dye-receiving layer or overcoat layer of the image receiving Sheet in order to prevent the sublimation thermal image transfer recording sheet from sticking to the image receiving sheet because the shear stress generated between the image receiving sheet and the recording sheet becomes considerably large in the n-times-speed rode. However, the increase of the beat resistance of the dye-receiving layer or overcoat layer of the image receiving sheet will hinder the sublimable dye constituting a dye image from being diffused into the inside of the dye-receiving layer or overcoat layer. As compared with the dye image formed on the image receiving sheet by the equal-speed mode, a larger amount of sublimable dye is present in the surface portion of the dye-receiving layer or overcoat layer, not penetrating into the inside of such a layer when transferred to the image receiving sheet by the n-times-speed mode. Therefore, the durability of the image-bearing image receiving sheet cannot be increased when the n-times-speed mode is employed. In the sublimation thermal image transfer recording method of the present invention, there is provided the step of subjecting the image-bearing image receiving sheet to heat treatment after the image recording step. Such heat treatment step can solve the above-mentioned problems caused by the n-times-speed mode.

The overcoat layer of the image receiving sheet is provided with sufficient heat resistance and lubricity in the present invention. In view of these points, it is preferable that the image receiving sheet according to the present invention comprise a substrate, a dye-receiving layer formed on the substrate, and an overcoat layer formed on the dye-receiving layer, the overcoat layer having a coefficient of dynamic friction of less than 0.45 which is measured in accordance with ASTM-D1894 and comprising a silicone resin and a lubricant.

The coefficient of dynamic friction of the overcoat layer, which is obtained in accordance with ASTM-D1894, can be measured using a commercially available surface property tester (Trademark "HEIDON", made by Shinto Scientific Co., Ltd.) in such a manner that an aromatic polyamide film with a softening point of 200° C. or more (Trademark "TX-1", made by Toray Industries, Inc.) was brought into contact with an overcoat layer of the image receiving sheet, and the friction coefficient is measured with the aromatic polyamide film being moved at a speed of 75 mn/min under the application of a load of 200 g thereto at 100° C.

Specific examples of the lubricant for use in the above-mentioned overcoat layer of the image receiving sheet are as follows; petroleum-based lubricating oils such as liquid paraffin; synthetic lubricating oils such as halogenated hydrocarbon, diester oil, silicone oil and fluorine-containing silicone oil; a variety of modified silicone oils such as epoxy-modified silicone oil, amino-modified silicone oil, alkyl-modified silicone oil and polyether-modified silicone oil; silicone-based lubricating materials or silicone copolymers, for example, a copolymer of an organic compound such as polyoxyalkylene glycol and silicone; a variety of fluorochemical surfactants such as fluoroalkyl compounds; a fluorine-containing lubricating materials such as low-molecular trifluoroethylene chloride; waxes such as paraffin wax and polyethylene wax; higher aliphatic alcohols; higher aliphatic amides; higher fatty acid esters; higher fatty acid salts; and molybdenum disulfide in the overcoat layer.

Those lubricants can be used alone or in combination.

Particularly, it is preferable that the lubricant for use in the overcoat layer comprise a silicone copolymer, such as a silicone block copolymer or a silicone graft copolymer. When the silicone copolymer is compared with a liquid-type lubricant such as a silicone oil, the friction coefficient of the overcoat layer can be surely reduced so as to effectively prevent the sticking problem without making the surface of the overcoat layer adhesive. This is because a silicone chain can be disposed on the surface portion of the overcoat layer when the silicone copolymer, especially the silicone graft copolymer, is added to the overcoat layer as the lubricant. In contrast to this, the liquid-type lubricant such as a silicone oil tends to bleed to the surface of the overcoat layer, so that the surface of the overcoat layer becomes sticky.

The silicone copolymer for use in the overcoat layer includes a silicone block copolymer or a silicone graft copolymer, which is prepared by the polymerization of a resin with silicone.

Examples of the resin polymerizable with the silicone are acrylic resin, polystyrene resin, polynitrile resin, polyamide resin, polyolefin resin, epoxy resin, polybutyral resin, melamine resin, vinyl chloride resin, polyurethane resin and polyvinyl ether resin.

In view of the improvement of anti-sticking performance, the silicone graft copolymer is further preferable. In this case, it is preferable that the silicone graft copolymer comprise a resin with a high dyeability which constitutes a main backbone chain thereof.

The dyeability of the resin is evaluated by the following method: a sample resin is dissolved in a volatile solvent at a concentration of 5 to 20% to prepare a resin solution, and a mixture of commercially available modified silicone oils (Trademarks "SF8411" and "SF8427", made by Toray Silicone Co., Ltd.) with a mixing ratio by weight of 1:1. is added to the above-mentioned resin solution in an amount of 30 wt. % of the solid content of the sample resin. The thus obtained mixture is coated on a commercially available synthetic paper (Trademark "Yupo FPG#95", made by Oji-Yuka Synthetic Paper Co., Ltd.) and dried at 70° C. for one minute and then at room temperature for one day or more. Thus, a resin layer with a thickness of about 10 $\mu$m on a day basis was provided on the synthetic paper.

Then, an ink ribbon of cyan color for use in a commercially available color video processor (Trademark "SCT-CP200", made by Mitsubishi Electric Corp.) is superimposed on the above prepared resin layer provided on the synthetic paper. A cyan-color image is recorded on the resin layer by the application of thermal energy of 2.00 mJ/dot to the ink ribbon using a thermal head (Trademark "KMT-85-6MPD4", made by Kyocera Corp.) with a resolution of 6 dot/mm and an average resistivity of 542 Ω. The image density of the thus recorded image is measured using McBeth reflection type densitometer RD-918. In the case where the image density is 1.2 or less, the sample resin for use in the resin layer is regarded as a resin with low dyeability. On the other hand, the sample resin which bears an image with an image density of more than 1.2 is regarded as a resin with high dyeability.

Specific examples of the dyeable resin capable of constituting the main backbone chain of the silicone graft polymer are polyamide resin, polyolefin resin, epoxy resin, polybutyral resin, and polyurethane resin. For instance, there can be employed the following commercially available products; "Daiallomer SP3023", "Daiallomer SP2105", "Daiallomer SP711" and "Daiallomer SP712" (Trademarks), made by Dainichiseika Color and Chemicals Mfg. Co., Ltd.

At the image recording operation, the sublimable dye transferred from the recording layer of the sublimation thermal image transfer recording sheet to the overcoat layer of the image receiving sheet is diffused to the dye-receiving layer. However, a small amount of sublimable dye remains in the overcoat layer. When the overcoat layer is provided with dyeability, the remaining sublimable dye in the overcoat layer is stabilized, with the result that the deterioration of image quality can be prevented while the image-bearing image receiving sheet is stored for an extended period of time. To be more specific, it is possible to prevent the decrease of image density which is caused by bleeding of a dye to the surface of the image receiving sheet, and to prevent the occurrence of image blurring which is caused by staining with the dye.

It is preferable that the overcoat layer for use in the image receiving sheet comprise a silicone resin and the above-mentioned lubricant in combination. Due to high heat resistance and releasability obtained by the silicone resin and high lubricity by the above-mentioned lubricant, the sticking problem of the image receiving sheet to the recording sheet, and the breakage of the image receiving sheet can be avoided during the sublimation thermal image transfer recording operation even though the recording operation is carried out by the n-times-speed mode. As a result, high quality images can be obtained.

The thickness of the overcoat layer for use in the image receiving sheet is preferably in the range of about 0.05 to 10 $\mu$m. Furthermore, when the thickness of the overcoat layer is 2 $\mu$m or less, the sublimable dye transferred from the recording layer of the recording sheet to the overcoat layer of the image receiving sheet in the course of thermal transfer recording operation can be adequately diffused into the inside of the dye-receiving layer with high dyeability. As a result, the image density of the recorded image can he increased. Further, the amount of the sublimable dye remaining in the overcoat layer can be reduced, so that the deterioration of image quality can be effectively prevented during a long-term storage, In order to improve the anti-sticking performance without decreasing the image density, it is preferable that the silicone resin, which shows low dyeability, be contained in the overcoat layer in an amount of less than 85 wt. % of the total weight of the overcoat layer. When the silicone resin is used in combination with the above-mentioned silicone graft copolymer in the overcoat layer, it is preferable that the main backbone chain of the silicone graft copolymer comprise a dyeable resin.

In the case where the overcoat layer of the image receiving sheet comprises the silicone resin and the silicone graft copolymer in combination, a silicone oil may be further contained in the overcoat layer for more effectively improving the anti-sticking performance.

Examples of the silicone oil for use in the overcoat layer include an alcohol-modified silicone oil, a fluorine-modified silicone oil, an amino-modified silicone oil, a carboxy-modified silicone oil and a polyether-modified silicone oil. In particular, an unmodified silicone oil and an epoxy-modified silicone oil are preferable.

Specific examples of the unmodified silicone oil are dimethyl silicone oil, methylphenyl silicone oil and methyl hydrogen silicone oil. For instance, there can be employed the following commercially available unmodified silicone oil products: "KF96L", "KF96", "KP96H", "KF69", "KF92", "KF961", "XF50", "KF54", "KF965", "KF968" and "KF56" (Trademarks), made by Shin-Etsu Chemical Co., Ltd.; and "SH200", "BY16-140", "SH510", "SH550", "SH710" and "H1107" (Trademarks), made by Dow Corning Toray Silicone Co., Ltd.

The epoxy-modified silicone oil for use in the present invention comprises a dimethylsilicone skeleton and an epoxy group introduced into both ends or a side chain thereof. There can be employed the following commercially available epoxy-modified silicone oil products: "KF100T", "KF101", "KF102" and "KF103" (Trademarks), made by Shin-Etsu Chemical Co., Ltd.; and "BX16-854", "BX16-854B", "BY16-839", "BY16-855", "BY16-855B", "SF8413" and "SP841" (Trademarks), made by Dow Corning Toray Silicone Co., Ltd.

It is preferable that the silicone oil be contained in the overcoat layer in an amount of 3 to 50 wt. %, more preferably in the range of 5 to 15 wt. %, of the total weight of the resin components for use in the overcoat layer. In this case, the amount of silicone oil moving to the surface portion of the overcoat layer is so proper as to prevent the sticking problem. If the amount of the silicone oil is excessively increased, an excess amount of silicone oil tends to bleed to the surface of the overcoat layer, with the result that the blocking phenomenon takes place. Thus, the image-bearing image receiving sheet tends to attach to a plastic cover when held in such a plastic cover for storage.

When the overcoat layer comprising a silicone oil is provided on the dye-receiving layer, a coating liquid for the overcoat layer may be prepared by mixing a silicone resin, a lubricant, a silicone oil, and a solvent which comprises a solvent component compatible with the silicone oil, with the amount of the above-mentioned solvent component compatible with the silicone oil being controlled to 25 wt. % or more of the total weight of the solvent for use in the coating liquid. By employing such a solvent component compatible with the silicone oil as mentioned above, the obtained overcoat layer coating liquid can be coated on the dye-receiving layer without forming any cissing, so that the film-forming performance of the overcoat layer becomes excellent. When the film-forming performance of the overcoat layer is excellent, the dye image transferred from the recording sheet to the overcoat layer of the image receiving sheet is free from unevenness.

The above-mentioned coating liquid for the overcoat layer may be prepared using one kind of solvent component compatible with the silicone oil, or a plurality of solvent components including the above-mentioned solvent component compatible with the silicone oil in light of the improvement of film-forming performance and solubility of the employed resin components.

The silicone resin for use in the overcoat layer is a three-dimensional cross-linked silicone polymer having a siloxane bond in the main chain thereof. For instance, there can be employed the following commercially available products: "SR2406", "SR2410", "SR2420", "SR2416", "SR2405" and "SR1" (Trademarks), made by Dow Corning Toray Silicone Co., Ltd.; and "KR220", "KR230", "KR255", "KR280", "KR285", "KR211", "KR212", "KR214" and "KR216" (Trademarks), made by Shin-Etsu Chemical Co., Ltd.

In the course of the preparation of the above-mentioned silicone polymer, the crosslinking reaction may be accelerated, when necessary, by use of a catalyst such as metallic salts (salts of lead, iron or tin) of organic carboxylic acid, or amine.

The overcoat layer for use in the image receiving sheet may further comprise an ultraviolet absorber in order to further improve the light resistance of the recorded image.

In the present invention, there can be employed a variety of conventional ultraviolet absorbers, for example, of benzophenone type, benzotriazole type, cyanoacrylate type, salicylate type, and oxalic anilide type.

When a low-molecular weight ultraviolet absorber is employed, it is preferable that the melting point of such an ultraviolet absorber be 60° C. or more to prevent the image receiving sheet from sticking to the sublimation thermal image transfer recording sheet in the course of image recording and to prevent the image density of the recorded images from becoming uneven. The conventional high-molecular weight ultraviolet absorbers can also be employed.

It is preferable that the amount of the ultraviolet absorber for use in the overcoat layer be in the range of 1 to 50 wt. % of the total weight of the resin components for use in the overcoat layer. When the amount of ultraviolet absorber is less than 1 wt. %, improvement of the light resistance cannot be expected. In addition, when the amount of ultraviolet absorber exceeds 50 wt. %, the image receiving sheet becomes yellowish as a whole because the ultraviolet absorber itself is yellowish as a whole result, the whiteness degree of the image receiving sheet is decreased. In addition, the image quality is degraded because of bleeding of the ultraviolet absorber.

The overcoat layer for use in the image receiving sheet may further comprise a variety of conventional additives, such as an antioxidant and a photostabilizer when necessary.

For the purpose of preventing the image receiving sheet from being curled, the image receiving sheet may further comprise a polyethylene layer which is provided an the back side of the substrate, opposite to the dye-receiving layer with respect to the substrate. In this case, the polyethylene layer can be attached to the substrate by the conventional method, for example, extrusion laminating.

The above-mentioned polyethylene layer may comprise an antistatic agent and a filler when necessary.

Any conventional antistatic agents can be employed for the polyethylene layer. Examples of the antistatic agent for use in the polyethylene layer include (i) anionic antistatic agents of a phosphate ester type and a sulfonic acid type; (ii) cationic antistatic agents of a quaternary ammonium salt type and a tertiary amine type; (iii) nonionic anti-static agents of an ester of polyhydric alcohol type, an amide type and a fatty acid ester type; and (iv) ampholytic antistatic agents.

Examples of the filler for use in the polyethylene layer are calcium carbonate, silica, titanium oxide and zinc oxide. By the addition of the filler to the polyethylene layer, the blocking and offset of the dye can be prevented, so that the preservation stability of the image recorded on the image receiving sheet can be improved more effectively.

Furthermore, the polyethylene layer may be subjected to matte finish for the improvement of writing characteristics.

The thickness of the polyethylene layer provided on the back side of the substrate is preferably in the range of about 0.1 to 50 $\mu$m.

The form and size of the substrate for use in the image receiving sheet are not particularly limited. The substrate in the form of a card can be employed in the present invention. The image receiving sheet in the form of a card is not curled even though the heat treatment step is carried out by the application of a large quantity of thermal energy. Such a card-shaped substrate may be made from polyester or vinyl chloride. This type of substrate may be provided with IC memory, a magnetic layer and a printed layer. Further, the above-mentioned substrate may be attached to a void-containing plastic film, thereby forming a laminated substrate.

In the sublimation thermal image transfer recording method of the present invention, any conventional sublimation thermal image transfer recording sheet that comprises a substrate and at least one recording layer formed thereon, comprising a sublimable-dye-containing ink area can be employed. In particular, when the sublimation thermal image transfer recording is carried out by moving the sublimation thermal image transfer recording sheet with a speed of 1/n (n>1) relative to the image receiving sheet with a speed of 1, it is preferable that the recording layer of the sublimation thermal image transfer recording sheet comprise a dye-supply layer containing a sublimable dye at a relatively high concentration and a dye-transfer layer containing a sublimable dye at a relatively low concentration which are successively overlaid on the substrate in this order, as disclosed in Japanese Laid-Open Patent Application 2-586.

Specific examples of the sublimable dye for use in the recording layer of the sublimation thermal image transfer recording sheet include C.I. Disperse Yellow 1, 3, 8, 9, 16, 41, 54, 60, 77 and 116; C.I. Disperse Red 1, 4, 6, 11, 15, 17, 55, 59, 60, 73 and 83; C.I. Disperse Blue 3, 14, 19, 26, 56, 60, 64, 72, 99 and 108; C.I. Solvent Yellow 77 and 116; C.I. Solvent Red 23, 25 and 27; and C.I. Solvent Blue 36, 83 and 105. These dyes can be used alone or in combination.

For the preparation of the recording layer of the sublimation thermal image transfer recording sheet, the above-mentioned sublimable dye is dissolved or dispersed in a binder resin. As the binder resin for use in the recording layer, a thermoplastic or thermosetting resin can be employed.

Specific examples of the thermoplastic and thermosetting resins for use in the recording layer include polyvinyl chloride resin, polyvinyl acetate resin, polyamide, polyethylene, polycarbonate, polystyrene, polypropylene, acrylic resin, phenolic resin, polyester, polyurethane, epoxy resin, silicone resin, butyral resin, polyvinyl alcohol, and cellulose resin. These resins can be used alone or in combination. In addition, a variety of copolymers comprising the monomers for use in the above-mentioned resins can be employed.

In the sublimation thermal image transfer recording sheet, it is preferable that the dye-transfer layer or a top layer provided on the surface of the recording sheet further comprise a lubricant.

Examples of the lubricant for use in the above-mentioned layer include petroleum lubricating oils such as liquid paraffin; synthetic lubricating oils such as halogenated hydrocarbon, diester oil, silicone oil and fluorine-contained silicone oil; a variety of modified silicone oils such as epoxy-modified silicone oil, amino-modified silicone oil, alkyl-modified silicone oil and polyether-modified silicone oil; silicone-based lubricating materials, for example, a copolymer of an organic compound such as polyoxyalkylene glycol and silicone; a variety of fluorochemical surfactants such as fluoroalkyl compounds; fluorine-containing lubricating materials such as low-molecular weight trifluoroethylene chloride; waxes such as paraffin wax and polyethylene wax; higher fatty acids; higher aliphatic alcohols; higher aliphatic amides; higher fatty acid esters; higher fatty acid salts; and molybdenum disulfide.

These lubricants may be used alone or in combination in the recording sheet.

According to the sublimation thermal image transfer recording method of the present invention, after the images are recorded on the image receiving sheet, the image-bearing image receiving sheet is subjected to heat treatment by applying the thermal energy to the image receiving sheet using a thermal head, through a sheet member for heat treatment. In the course of the above-mentioned heat treatment, the thermal head can be protected by using the sheet member which is interposed between the thermal head and the image-bearing image receiving sheet.

It is preferable that the aforementioned sheet member for heat treatment have a heating area which is shorter in the transporting direction thereof than the length of an image area recorded on the image receiving sheet in the transporting direction thereof.

The recording layer of the sublimation thermal image transfer recording sheet may be provided with an area free of the sublimable dye and an ink area comprising a sublimable dye side by side. In this case, the sublimable-dye-free area can be used as the sheet member for heat treatment, so that an additional sheet member for heat treatment becomes unnecessary.

To be more specific, the recording layer of the sublimation thermal image transfer recording sheet comprises ink areas of yellow, magenta and cyan, and optionally black when necessary, and a sublimable-dye-free area, with those ink areas and sublimable-dye-free area being disposed side by side in the transporting direction of the recording sheet. The sublimable-dye-free area may be shorter than the length of the image area recorded on the image receiving sheet in the transporting direction thereof.

For achieving the heat treatment by the n-times-speed mode satisfactorily, it is preferable that the sheet member for heat treatment, for example, the sublimable-dye-free area in the recording layer of the recording sheet comprise a surface layer comprising a resin with low dyeability, which layer comes in contact with the image-bearing surface of the image receiving sheet.

Examples of the above-mentioned resin with low dyeability include aromatic polyester resin, styrene butadiene resin, polyvinyl acetate resin, and polyamide resin. In particular, methacrylate resin and copolymers thereof, styrene—maleic acid ester copolymer, polyimide resin, silicone resin and copolymers thereof, styrene acrylonitrile resin, and polysulfone resin are further preferable.

The sheet member for heat treatment may further comprise a heat-resistant lubricating layer which is provide on the back side of the sheet member, in contact with the thermal head. Thus, the heat treatment can be perfectly carried out when the n-times-speed mode is employed in the heat treatment.

Other features of this invention will become apparent in the course of the following description of exemplary embodiments, which are given for illustration of the invention and are not intended to be limiting thereof.

EXAMPLE 1

Preparation of Sublimation Thermal Image Transfer Recording Sheet A

Formation of adhesive layer

The following components were mixed to prepare a coating liquid for an adhesive layer:

| | Parts by Weight |
|---|---|
| Polyvinyl butyral resin "BX-1" (Trademark) made by Sekisui Chemical Co., Ltd. | 10 |
| Isocyanate "Coronate L" (Trademark) made by Nippon Polyurethane Industry Co., Ltd. | 10 |
| Toluene | 95 |
| Methyl ethyl ketone | 95 |

On one surface of an aromatic polyamide film with a thickness of 6 μm, bearing a 1-μm-thick heat-resistant silicone resin layer on the other surface thereof, the above prepared coating liquid for the adhesive layer was coated by a wire bar, and dried at 120° C. for 90 seconds. Then, the coated layer was subjected to aging at 60° C. for 24 hours. Thus, an adhesive layer with a thickness of 1 μm was provided on the substrate.

Formation of dye supply layer

The following components were mixed to prepare a coating liquid for a dye supply layer:

| | Parts by Weight |
|---|---|
| Polyvinyl butyral resin "BX-1" (Trademark) made by Sekisui Chemical Co., Ltd. | 10 |
| Isocyanate "Coronate L" (Trademark) made by Nippon Polyurethane Industry Co., Ltd. | 5 |
| Sublimable dye "R-1" (Trademark) made by Nippon Kayaku Co., Ltd. | 25 |
| Ethanol | 180 |
| n-butanol | 10 |

The above prepared coating liquid for the dye supply layer was coated on the adhesive layer by a wire bar, and dried at 100° C. for 90 seconds. Thus, a dye-supply layer with a thickness of 3 μm was provided on the adhesive layer.

Formation of dye-transfer layer

The following components were mixed to prepare a coating liquid for a dye-transfer layer:

| | Parts by Weight |
|---|---|
| Polyvinyl butyral resin "BX-1" (Trademark) made by Sekisui Chemical Co., Ltd. | 10 |
| Isocyanate "Coronate L" (Trademark) made by Nippon Polyurethane Industry Co., Ltd. | 5 |

-continued

| | Parts by Weight |
|---|---|
| Sublimable dye "R-1" (Trademark) made by Nippon Kayaku Co., Ltd. | 10 |
| Toluene | 95 |
| Methyl ethyl ketone | 95 |

The above prepared coating liquid for the dye transfer layer was coated on the dye-supply layer by a wire bar, and dried at 100° C. for 90 seconds. Thus, a dye-transfer layer with a thickness of 1 μm was provided on the dye-supply layer.

Formation of resin layer with low dyeability 15 g of dimethylmethoxy silane and 9 g of methyltrimethoxy silane were dissolved in a mixed solvent consisting of 12 g of toluene and 12 g of methyl ethyl ketone to prepare a mixture solution. With the addition of 13 ml of 3% sulfuric acid, the obtained mixture was hydrolyzed for 3 hours. Thus, a liquid A was obtained.

The following components were mixed to prepare a coating liquid for a resin layer with low dyeability:

| | Parts by Weight |
|---|---|
| Styrene-maleic acid copolymer "Suprapal AP30" (Trademark) made by BASF Japan Ltd. | 10 |
| Liquid A | 12 |
| Tetrahydrofuran | 20 |
| Methyl ehtyl ketone | 95 |

The above prepared coating liquid for the resin layer was coated on the dye-transfer layer by a wire bar, and dried at 100° C. for 90 seconds, so that a resin layer with low dyeability having a thickness of 1 μm was provided on the dye-transfer layer. The thus obtained laminated material was subjected to aging at 60° C. for 24 hours.

Thus, a sublimation thermal image transfer recording sheet A for use in the present invention was prepared.

Preparation of image-receiving Sheet No. 1

The following components were mixed to prepare a coating liquid for a dye-receiving layer:

| | Parts by Weight |
|---|---|
| Vinyl chloride-vinyl acetate-"Denka Vinyl #1000GKT" (Trademark) made by Denki Kagaku Kogyo K.K. | 9.4 |
| Isocyanate "D140N" (Trademark) made by Takeda Chemical | 3.2 |
| Toluene | 21.4 |
| Methyl ethyl ketone | 64.3 |

The thus obtained dye-receiving layer coating liquid was coated on a sheet of commercially available synthetic paper (Trade-mark "Yapo", made by Oji-Yuka Synthetic Paper Co., Ltd.), and dried at 80° C., so that a dye-receiving layer with a thickness of 5 μm was provided on the substrate.

Formation of overcoat layers

The following components were mixed to prepare a coating liquid for an overcoat layer:

| | Parts by Weight |
|---|---|
| Silicone resin "SR2411" (Trademark) made by Dow Corning Toray Silicone Co., Ltd. | 9.25 |
| Silicone graft copolymer resin "SP712" (Trademark) Dainichiseika Color and Chemicals Mfg. Co., Ltd. | 14.80 |
| Ultraviolet absorber "Sumisorb 100" (Trademark) made by Sumitomo Chemical Co., Ltd. | 0.02 |
| Epoxy-modified silicone oil "SF8411" (Trademark) made by Dow Corning Toray Silicone Co., Ltd. | 0.37 |
| Isopropyl alcohol | 37.96 |
| Toluene | 37.96 |

The thus obtained overcoat layer coating liquid was coated on the dye-receiving layer and dried at 100° C., and subjected to aging at 80° C. for 16 hours, so that an overcoat layer with a thickness of 1.0 μm was provided on the dye-receiving layer.

Thus, an image-receiving sheet No 1 according to the present invention was obtained.

Then, the sublimation thermal image transfer recording sheet A was superimposed on the image receiving sheet No. 1 in such a manner that the resin layer of the sublimation thermal image transfer recording sheet A came into contact with the overcoat layer of the image receiving sheet No. 1, and images were recorded on the overcoat layer of the image receiving sheet No. 1 by applying thermal energy imagewise to the sublimation thermal image transfer recording sheet A from the substrate side thereof using a thermal head, under the following conditions:

Applied electric power: 0.16 W/dot

Recording density of thermal head: 12 dot/mm

Applied thermal energy: 0.64 mJ/dot (Transporting speed of image-receiving sheet)/(Transporting speed of recording sheet): 12

EXAMPLE 2

The procedure for preparation of the image receiving sheet No. 1 in Example 1 was repeated except that the amount of the ultraviolet absorber for use in the overcoat layer coating liquid in Example 1 was changed from 0.02 to 0.74 parts by weight.

Thus, an image receiving sheet No. 2 according to the present invention was prepared.

Then, the sublimation thermal image transfer recording sheet A was superimposed on the image receiving sheet No. 2 in such a manner that the resin layer of the sublimation thermal image transfer recording sheet A came into contact with the overcoat layer of the image receiving sheet No. 2, and images were recorded on the overcoat layer of the image receiving sheet No. 2 by applying thermal energy imagewise to the sublimation thermal image transfer recording sheet A from the substrate side thereof using a thermal head, under the same conditions as in Example 1.

EXAMPLE 3

The procedure for preparation of the image receiving sheet No. 1 in Example 1 was repeated except that the amount of the ultraviolet absorber for use in the overcoat layer coating liquid in Example 1 was changed from 0.02 to 2.22 parts by weight.

Thus, an image receiving sheet No. 3 according to the present invention was prepared.

Then, the sublimation thermal image transfer recording sheet A was superimposed on the image receiving sheet No. 3 in such a manner that the resin layer of the sublimation thermal image transfer recording sheet A came into contact with the overcoat layer of the image receiving sheet No. 3, and images were recorded on the overcoat layer of the image receiving sheet No. 3 by applying thermal energy imagewise to the sublimation thermal image transfer recording sheet A from the substrate side thereof using a thermal head, under the same conditions as in Example 1.

EXAMPLE 4

The sublimation thermal image transfer recording sheet A was superimposed on the image receiving sheet No. 1 prepared in Example 1 in such a manner that the resin layer of the sublimation thermal image transfer recording sheet A came into contact with the overcoat layer of the image receiving sheet No. 1, and images were recorded on the overcoat layer of the image receiving sheet No. 1 by applying thermal energy imagewise to the sublimation thermal image transfer recording sheet A from the substrate side thereof using a thermal head, under the same conditions as in Example 1.

Preparation of Sheet Member (I) for Heat Treatment

Formation of adhesive layer

The following components were mixed to prepare a coating liquid for an adhesive layer:

| | Parts by Weight |
|---|---|
| Polyvinyl butyral resin "BX-1" (Trademark) made by Sekisui Chemical Co., Ltd. | 10 |
| Isocyanate "Coronate L" (Trademark) made by Nippon Polyurethane Industry Co., Ltd. | 10 |
| Toluene | 95 |
| Methyl ethyl ketone | 95 |

On one surface of an aromatic polyamide film with a thickness of 6 μm, bearing a 1-μm-thick heat-resistant silicone resin layer on the other surface thereof, the above prepared coating liquid for the adhesive layer was coated by a wire bar, and dried at 120° C. for 90 seconds. Then, the coated layer was subjected to aging at 60° C. for 24 hours. Thus, an adhesive layer with a thickness of 1 μm was provided on the substrate.

Formation of resin layer with low dyeability 15 g of dimethylmethoxy silane and 9 g of methyltrimethoxy silane were dissolved in a mixed solvent consisting of 12 g of toluene and 12 g of methyl ethyl ketone to prepare a mixture solution. With the addition of 13 ml of 3% sulfuric acid, the obtained mixture was hydrolyzed for 3 hours. Thus, a liquid A was obtained.

The following components were mixed to prepare a coating liquid for a resin layer with low dyeability:

| | Parts by Weight |
|---|---|
| Styrene-maleic acid copolymer "Suprapal AP30" (Trademark) made by BASF Japan Ltd. | 10 |
| Liquid A | 12 |
| Tetrahydrofuran | 20 |
| Methyl ethyl ketone | 95 |

The above prepared coating liquid for the resin layer was coated on the adhesive layer by a wire bar, and dried at 100° C. for 90 seconds, so that a low dyeable resin layer with a thickness of 1 μm was provided on the adhesive layer. The thus laminated material was subjected to aging at 60° C. for 24 hours.

Thus, a sheet member (I) for heat treatment for use in the present invention was prepared.

After the completion of the image recording, the sheet member (I) for heat treatment was superimposed on the image-bearing image receiving sheet No. 1 in such a manner that the resin layer of the sheet member (I) was in contact with the image-bearing surface of the image receiving sheet No. 1, and heat treatment was carried out by applying thermal energy thereto under the following conditions:

Recording density of thermal head: 12 dot/mm

Applied thermal energy: 0.50 mJ/dot (Transporting speed of image-receiving sheet)/(Transporting speed of sheet member for heat treatment): 1

EXAMPLE 5

The sublimation thermal image transfer recording sheet A was superimposed on the image receiving sheet No. 1 prepared in Example 1 in such a manner that the low-dyeable resin layer of the sublimation thermal image transfer recording sheet A came into contact with the overcoat layer of the image receiving sheet No. 1, and images were recorded on the overcoat layer of the image receiving sheet No. 1 by applying thermal energy imagewise to the sublimation thermal image transfer recording sheet A from the substrate side thereof using a thermal head, under the same conditions as in Example 1.

Thereafter, the same sheet member (I) for heat treatment as prepared in Example 4 was superimposed on the image-bearing image receiving sheet No. 1 in such a manner that the low-dyeable resin layer of the sheet member (I) was in contact with the image-bearing surface of the image receiving sheet No. 1, and heat treatment was carried out by applying thermal energy thereto under the same conditions as in Example 4 except that the applied thermal energy was changed from 0.50 to 0.60 mJ/dot.

EXAMPLE 6

The sublimation thermal image transfer recording sheet A was superimposed on the image receiving sheet No. 1 prepared in Example 1 in such a manner that the low-dyeable resin layer of the sublimation thermal image transfer recording sheet A came into contact with the overcoat layer of the image receiving sheet No. 1, and images were recorded on the overcoat layer of the image receiving sheet No. 1 by applying thermal energy imagewise to the sublimation thermal image transfer recording sheet A from the substrate side thereof using a thermal head, under the sane conditions as in Example 1.

Thereafter, the same sheet member (I) for heat treatment as prepared in Example 4 was superimposed on the image-bearing image receiving sheet No. 1 in such a manner that the low-dyeable resin layer of the sheet member (I) was in contact with the image-bearing surface of the image receiving sheet No. 1, and heat treatment was carried out by applying thermal energy thereto under the same conditions as in Example 5 except that the ratio of the transporting speed of the image receiving sheet No. 1 to that of the sheet member (I) for heat treatment was changed from 1 to 9.

EXAMPLE 7

The sublimation thermal image transfer recording sheet A was superimposed on the image receiving sheet No. 1 prepared in Example 1 in such a manner that the low-dyeable resin layer of the sublimation thermal image transfer recording sheet A came into contact with the overcoat layer of the image receiving sheet No. 1, and images were recorded on the overcoat layer of the image receiving sheet No. 1 by applying thermal energy imagewise to the sublimation thermal image transfer recording sheet A from the substrate side thereof using a thermal head, under the same conditions as in Example 1.

Thereafter, the same sheet member (I) for heat treatment as prepared in Example 4 was superimposed on the image-bearing image receiving sheet No. 1 in such a manner that the low-dyeable resin layer of the sheet member (I) was in contact with the image-bearing surface of the image receiving sheet No. 1, and heat treatment was carried out by applying thermal energy thereto under the same conditions as in Example 4 except that the ratio of the transporting speed of the image receiving sheet No. 1 to that of the sheet member (I) for heat treatment was changed from 1 to 12.

EXAMPLE 8

The sublimation thermal image transfer recording sheet A was superimposed on the image receiving sheet No. 1 prepared in Example 1 in such a manner that the low-dyeable resin layer of the sublimation thermal image transfer recording sheet A came into contact with the overcoat layer of the image receiving sheet No. 1, and images were recorded on the overcoat layer of the image receiving sheet No. 1 by applying thermal energy imagewise to the sublimation thermal image transfer recording sheet A from the substrate side thereof using a thermal head, under the same conditions as in Example 1.

Thereafter, the same sheet member (I) for heat treatment as prepared in Example 4 was superimposed on the image-bearing image receiving sheet No. 1 in such a manner that the low-dyeable resin layer of the sheet member (I) was in contact with the image-bearing surface of the image receiving sheet No. 1, and heat treatment was carried out by applying thermal energy thereto under the same conditions as in Example 7 except that the applied thermal energy was changed from 0.50 to 0.53 mJ/dot.

EXAMPLE 9

The sublimation thermal image transfer recording sheet A was superimposed on the image receiving sheet No. 1 prepared in Example 1 in such a manner that the low-dyeable resin layer of the sublimation thermal image transfer recording sheet A came into contact with the overcoat layer of the image receiving sheet No. 1, and images were recorded on the overcoat layer of the image receiving sheet No. 1 by applying thermal energy imagewise to the sublimation thermal image transfer recording sheet A from the substrate side thereof using a thermal head, under the same conditions as in Example 1.

Thereafter, the same sheet member (I) for heat treatment as prepared in Example 4 was superimposed on the image-beating image receiving sheet No. 1 in such a manner that the low-dyeable resin layer of the sheet member (I) was in contact with the image-bearing surface of the image receiving sheet No. 1, and heat treatment was carried out by applying thermal energy thereto under the same conditions as in Example 7 except that the applied thermal energy was changed from 0.50 to 0.60 mJ/dot.

EXAMPLE 10

The sublimation thermal image transfer recording sheet A was superimposed on the image receiving sheet No. 1 prepared in Example 1 in such a manner that the low-dyeable resin layer of the sublimation thermal image transfer recording sheet A came into contact with the overcoat layer of the image receiving sheet No. 1, and images were recorded an the overcoat layer of the image receiving sheet No. 1 by applying thermal energy imagewise to the sublimation thermal image transfer recording sheet A from the substrate side thereof using a thermal head, under the same conditions as in Example 1.

Thereafter, the same sheet member (I) for heat treatment as prepared in Example 4 was superimposed on the image-bearing image receiving sheet No. 1 in such a manner that the low-dyeable resin layer of the sheet member (I) was in contact with the image-bearing surface of the image receiving sheet No. 1, and heat treatment was carried out by applying thermal energy thereto under the same conditions as in Example 7 except that the applied thermal energy was changed from 0.50 to 0.62 mJ/dot.

EXAMPLE 11

The sublimation thermal image transfer recording sheet A was superimposed on the image receiving sheet No. 1 prepared in Example 1 in such a manner that the low-dyeable resin layer of the sublimation thermal image transfer recording sheet A came into contact with the overcoat layer of the image receiving sheet No. 1, and images were recorded on the overcoat layer of the image receiving sheet No. 1 by applying thermal energy imagewise to the sublimation thermal image transfer recording sheet A from the substrate side thereof using a thermal head, under the same conditions as in Example 1.

Thereafter, the same sheet member (I) for heat treatment as prepared in Example 4 was superimposed on the image-bearing image receiving sheet No. 1 in such a manner that the low-dyeable resin layer of the sheet member (I) was in contact with the image-bearing surface of the image receiving sheet No. 1, and heat treatment was carried out by applying thermal energy thereto under the same conditions as in Example 5 except that the ratio of the transporting speed of the image receiving sheet No. 1 to that of the sheet member (I) for heat treatment was changed from 1 to 18.

EXAMPLE 12

The sublimation thermal image transfer recording sheet A was superimposed on the image receiving sheet No. 2 prepared in Example 2 in such a manner that the low-dyeable resin layer of the sublimation thermal image transfer recording sheet A came into contact with the overcoat layer of the image receiving sheet No. 2, and images were recorded on the overcoat layer of the image receiving sheet No. 2 by applying thermal energy imagewise to the sublimation thermal image transfer recording sheet A from the substrate side thereof using a thermal head, under the same conditions as in Example 2.

Thereafter, the same sheet member (I) for heat treatment as prepared in Example 4 was superimposed on the image-bearing image receiving sheet No. 2 in such a manner that the low-dyeable resin layer of the sheet member (I) was in contact with the image-bearing surface of the image receiving sheet No. 2, and heat treatment was carried out by applying thermal energy thereto under the same conditions as in Example 9.

EXAMPLE 13

The procedure for preparation of the image receiving sheet No. 1 in Example 1 was repeated except that the synthetic paper serving as the substrate of the image receiving sheet No. 1 in Example 1 was replaced by a sheet of coated paper (Trademark "OK Coat", made by Oji-Yuka Synthetic Paper Co., Ltd.).

Thus, an image receiving sheet No. 4 according to the present invention was prepared.

Then, the sublimation thermal image transfer recording sheet A was superimposed on the image receiving sheet No. 4 in such a manner that the low-dyeable resin layer of the sublimation thermal image transfer recording sheet A came into contact with the overcoat layer of the image receiving sheet No. 4, and images were recorded on the overcoat layer of the image receiving sheet No. 4 by applying thermal energy imagewise to the sublimation thermal image transfer recording sheet A from the substrate side thereof using a thermal head, under the same conditions as in Example 1.

EXAMPLE 14

The procedure for preparation of the image receiving sheet No. 1 in Example 1 was repeated except that the synthetic paper serving as the substrate of the image receiving sheet No. 1 in Example 1 was replaced by a laminated member of a sheet of coated paper (Trademark "OK Coat", made by Oji-Yuka Synthetic Paper Co., Ltd.) and a void-containing polypropylene film (Trademark: "Toyopearl ST", made by Toyobo Co., Ltd., with a density D/Do of 0.74).

Thus, an image receiving sheet No. 5 according to the present invention was prepared.

Then, the sublimation thermal image transfer recording sheet A was superimposed on the image receiving sheet No. 5 in such a manner that the low-dyeable resin layer of the sublimation thermal image transfer recording sheet A came into contact with the overcoat layer of the image receiving sheet No. 5, and images were recorded on the overcoat layer of the image receiving sheet No. 5 by applying thermal energy imagewise to the sublimation thermal image transfer recording sheet A from the substrate side thereof using a thermal head, under the same conditions as in Example 1.

EXAMPLE 15

The procedure for preparation of the image receiving sheet No. 1 in Example 1 was repeated except that the synthetic paper serving as the substrate of the image receiving sheet No. 1 in Example 1 was replaced by a laminated member of a sheet of coated paper (Trademark "OK Coat", made by Oji-Yuke Synthetic Paper Co., Ltd.) and a void-containing polypropylene film (Trademark "YP56", made by Toray Industries, Inc., with a density D/Do of 0.66).

Thus, an image receiving sheet No. 6 according to the present invention was prepared.

Then, the sublimation thermal image transfer recording sheet A was superimposed on the image receiving sheet No. 6 in such a manner that the low-dyeable resin layer of the sublimation thermal image transfer recording sheet A came into contact with the overcoat layer of the image receiving sheet No. 6, and images were recorded on the overcoat layer of the image receiving sheet No. 6 by applying thermal energy imagewise to the sublimation thermal image transfer recording sheet A from the substrate side thereof using a thermal head, under the same conditions as in Example 1.

EXAMPLE 16

The procedure for preparation of the image receiving sheet No. 2 in Example 2 was repeated except that the synthetic paper serving as the substrate of the image receiving sheet No. 2 in Example 2 was replaced by a laminated member of a sheet of coated paper (Trademark "OK Coat", made by Oji-Yuka Synthetic Paper Co., Ltd.) and a void-containing polyester film (Trademark "E60", made by Toray Industries, Inc., with a density D/Do of 0.62).

Thus, an image receiving sheet No. 7 according to the present invention was prepared.

Then, the sublimation thermal image transfer recording sheet A was superimposed an the image receiving sheet No. 7 in such a manner that the low-dyeable resin layer of the sublimation thermal image transfer recording sheet A came into contact with the overcoat layer of the image receiving sheet No. 7, and images were recorded on the overcoat layer of the image receiving sheet No. 7 by applying thermal energy imagewise to the sublimation thermal image transfer recording sheet A from the substrate side thereof using a thermal head, under the same conditions as in Example 1.

EXAMPLE 17

The procedure for preparation of the image receiving sheet No. 7 in Example 16 was repeated except that a polyethylene layer was further provided on the back side of the coated paper (Trademark "OK Coat", made by Cji-Yuka Synthetic Paper Co., Ltd.), opposite to the void-containing polyester film with respect to the coated paper.

Thus, an image receiving sheet No. 8 according to the present invention was prepared.

Then, the sublimation thermal image transfer recording sheet A was superimposed on the image receiving sheet No. 8 in such a manner that the low-dyeable resin layer of the sublimation thermal image transfer recording sheet A came into contact with the overcoat layer of the image receiving sheet No. 8, and images were recorded on the overcoat layer of the image receiving sheet No. 8 by applying thermal energy imagewise to the sublimation thermal image transfer recording sheet A from the substrate side thereof using a thermal head, under the same conditions as in Example 1.

EXAMPLE 18

The procedure for preparation of the image receiving sheet No. 2 in Example 2 was repeated except that the synthetic paper serving as the substrate of the image receiving sheet No. 2 in Example 2 was replaced by a laminated member of a white PET film with a thickness of 750 $\mu$m and a void-containing polyester film (Trademark "E60", made by Toray Industries, Inc., with a density D/Do of 0.62).

Thus, an image receiving sheet No. 9 according to the present invention was prepared.

Then, the sublimation thermal image transfer recording sheet A was superimposed on the image receiving sheet No. 9 in such a manner that the low-dyeable resin layer of the sublimation thermal image transfer recording sheet A came into contact with the overcoat layer of the image receiving sheet No. 9, and images were recorded on the overcoat layer of the image receiving sheet No. 9 by applying thermal energy imagewise to the sublimation thermal image transfer recording sheet A from the substrate side thereof using a thermal head, under the same conditions as in Example 1.

COMPARATIVE EXAMPLE 1

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. | 9.25 |
| Polyvinyl butyral "BK-1" (Trademark) made by Sekisui Chemical Co., Ltd. | 1.85 |
| Isopropyl alcohol | 88.90 |

Thus, a comparative image receiving sheet No. 1 was prepared.

Then, the sublimation thermal image transfer recording sheet A was superimposed on the comparative a image receiving sheet No. 1 in such a manner that the low-dyeable resin layer of the sublimation thermal image transfer recording sheet A came into contact with the overcoat layer of the comparative image receiving sheet No. 1, and images were recorded on the overcoat layer of the comparative image receiving sheet No. 1 by applying thermal energy imagewise to the sublimation thermal image transfer recording sheet A from the substrate side thereof using a thermal head, under the same conditions as in Example 1.

COMPARATIVE EXAMPLE 2

The procedure for preparation of the image receiving sheet No. 1 in Example 1 was repeated except that the formulation for the overcoat layer coating liquid for use in the image receiving sheet No. 1 in Example 1 was changed to the following formulation;

| | Parts by Weight |
|---|---|
| Polyvinyl butyral "BK-1" (Trademark) made by Sekisui Chemical Co., Ltd. | 3.70 |
| Epoxy-modified silicone oil "SF8411" (Trademark) made by Dow Corning Toray Silicone Co., Ltd. | 0.37 |
| Methyl ethyl ketone | 48.15 |
| Toluene | 48.15 |

Thus, a comparative image receiving sheet No. 2 was prepared.

Then, the sublimation thermal image transfer recording sheet A was superimposed on the comparative image receiving sheet No. 2 in such a manner that the low-dyeable resin layer of the sublimation thermal image transfer recording sheet A came into contact with the overcoat layer of the comparative image receiving sheet No. 2 , and images were recorded on the overcoat layer of the comparative image receiving sheet No. 2 by applying thermal energy imagewise to the sublimation thermal image transfer recording sheet A from the substrate side thereof using a thermal head, under the same conditions as in Example 1.

EXAMPLE 19

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. | 9.25 |
| Silicone graft copolymer resin "SP712" (Trademark) Dainichiseika Color and Chemicals Mfg. Co., Ltd. | 14.80 |
| Epoxy-modified silicone oil "SF8411" (Trademark) made by Dow Corning Toray Silicone Co., Ltd. | 0.37 |
| Isopropyl alcohol | 37.97 |
| Toluene | 37.97 |

Thus, an image receiving sheet No. 10 according to the present invention was prepared.

Then, the sublimation thermal image transfer recording sheet A was superimposed on the image receiving sheet No. 10 in such a manner that the low-dyeable resin layer of the sublimation thermal image transfer recording sheet A came into contact with the overcoat layer of the image receiving sheet No. 10, and images were recorded on the overcoat layer of the image receiving sheet No. 10 by applying thermal energy imagewise to the sublimation thermal image transfer recording sheet A from the substrate side thereof using a thermal head, under the same conditions as in Example 1.

EXAMPLE 20

The procedure for preparation of the image receiving sheet No. 1 in Example 1 was repeated except that the thickness of the overcoat layer for use in the image receiving sheet No. 1 in Example 1 was changed from 1.0 to 3 $\mu$m, and that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 18.5 |
| Alcohol-modified silicone oil | 0.37 |

-continued

| | Parts by Weight |
|---|---|
| "SF8427" (Trademark) made by Dow Corning Toray Silicone Co., Ltd. | |
| Isopropyl acohol | 81.5 |

Thus, an image receiving sheet No. 11 according to the present invention was prepared.

Then, the sublimation thermal image transfer recording sheet A was superimposed on the image receiving sheet No. 11 in such a manner that the low-dyeable resin layer of the sublimation thermal image transfer recording sheet A came into contact with the overcoat layer of the image receiving sheet No. 11 and a images were recorded on the overcoat layer of the image receiving sheet No. 11 by applying thermal energy imagewise to the sublimation thermal image transfer recording sheet A from the substrate side thereof using a thermal head, under the same conditions as in example 1.

EXAMPLE 21

The procedure for preparation of the image receiving sheet No. 1 in Example 1 was repeated except that the thickness of the overcoat layer for use in the image receiving sheet No. 1 in Example 1 was changed from 1.0 to 3 $\mu$m, and that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 16.65 |
| Acryl-silicone block copolymer "LDL500" (Trademark) made by Natoco Paint Co., Ltd. (Solvent: isopropyl alcohol Solid content: 30 wt. % Dyeability: 1.02) | 0.37 |
| Isopropyl alcohol | 85.5 |

Thus, an image receiving sheet No. 12 according to the present invention was prepared.

Then, the sublimation thermal image transfer recording sheet A was superimposed on the image receiving sheet No. 12 in such a manner that the low-dyeable resin layer of the sublimation thermal image transfer recording sheet A came into contact with the overcoat layer of the image receiving sheet No. 12, and images were recorded on the overcoat layer of the image receiving sheet No. 12 by applying thermal energy imagewise to the sublimation thermal image transfer recording sheet A from the substrate side thereof using a thermal head, under the same conditions as in Example 1.

EXAMPLE 22

The procedure for preparation of the image receiving sheet No. 1 in Example 1 was repeated except that the thickness of the overcoat layer for use in the image receiving sheet No. 1 in Example 1 was changed from 1.0 to 3 $\mu$m, and that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 18.5 |
| Acryl-silicone graft copolymer resin "US350" (Trademark) made by Toagosei Co., Ltd. (Solvent: methyl ethyl ketone Solid content of resin: 30 wt. % Dyeability: 1.05) | 2.47 |
| Methyl ethyl ketone | 42.75 |
| Toluene | 42.75 |

Thus, an image receiving sheet No. 13 according to the present invention was prepared.

Then, the sublimation thermal image transfer recording sheet A was superimposed on the image receiving sheet No. 13 in such a manner that the low-dyeable resin layer of the sublimation thermal image transfer recording sheet A came into contact with the overcoat layer of the image receiving sheet No. 13, and images were recorded on the overcoat layer of the image receiving sheet No. 13 by applying thermal energy imagewise to the sublimation thermal image transfer recording sheet A from the substrate side thereof using a thermal head, under the same conditions as in Example 1.

EXAMPLE 23

The procedure for preparation of the image receiving sheet No. 1 in Example 1 was repeated except that the thickness of the overcoat layer for use in the image receiving sheet No. 1 in Example 1 was changed from 1.0 to 3 $\mu$m, and that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 9.25 |
| Acryl-silicone graft copolymer resin "US350" (Trademark) made by Toagosei Co., Ltd. (Solvent: methyl ethyl ketone Solid content of resin: 30 wt. % Dyeability: 1.05) | 6.17 |
| Methyl ethyl ketone | 42.75 |
| Toluene | 42.75 |

Thus, an image receiving sheet No. 14 according to the present invention was prepared.

Then, the sublimation thermal image transfer recording sheet A was superimposed on the image receiving sheet No. 14 in such a manner that the low-dyeable resin layer of the sublimation thermal image transfer recording sheet A came into contact with the overcoat layer of the image receiving sheet No. 14, and images were recorded on the overcoat layer of the image receiving sheet No. 14 by applying thermal energy imagewise to the sublimation thermal image transfer recording sheet A from the substrate side thereof using a thermal head, under the same conditions as in Example 1.

EXAMPLE 24

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 9.25 |
| Silicone graft copolymer resin "SP712" (Trademark) made by Dainichiseika Color and Chemicals Mfg. Co., Ltd. (Solvent: methyl ethyl ketone Solid content of resin: 12.5 wt. % Dyeability: 1.50 | 14.8 |
| Isopropyl Alcohol | 75.95 |

Thus, an image receiving sheet No. 15 according to the present invention was prepared.

Then, the sublimation thermal image transfer recording sheet A was superimposed on the image receiving sheet No. 15 in such a manner that the low-dyeable resin layer of the sublimation thermal image transfer recording sheet A came into contact with the overcoat layer of the image receiving sheet No. 15, and images were recorded on the overcoat layer of the image receiving sheet No. 15 by applying thermal energy imagewise to the sublimation thermal image transfer recording sheet A from the substrate side thereof using a thermal head, under the same conditions as in Example 1.

EXAMPLE 25

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 9.25 |
| Silicone graft copolymer resin "SP712" (Trademark) made by Dainichiseika Color and Chemicals Mfg. Co., Ltd. (Solvent: methyl ethyl ketone | 14.8 |

-continued

| | Parts by Weight |
|---|---|
| Solid content of resin: 12.5 wt. % Dyeability: 1.50 | |
| Amino-modified silicone oil "SF8417" (Trademark) made by Dow Corning Toray Silicone Co., Ltd. | 0.07 |
| Isopropyl alcohol | 75.95 |

Thus, an image receiving sheet No. 16 according to the present invention was prepared.

Then, the sublimation thermal image transfer recording sheet A was superimposed on the image receiving sheet No. 16 in such a manner that the low-dyeable resin layer of the sublimation thermal image transfer recording sheet A came into contact with the overcoat layer of the image receiving sheet No. 16, and images were recorded on the overcoat layer of the image receiving sheet No. 16 by applying thermal energy imagewise to the sublimation thermal image transfer recording sheet A from the substrate side thereof using a thermal head, under the same conditions as in Example 1.

EXAMPLE 26

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 9.25 |
| Silicone graft copolymer resin "SP712" (Trademark) made by Dainichiseika Color and Chemicals Mfg. Co., Ltd. (Solvent: methyl ethyl ketone, Solid content of resin: 12.5 wt. % Dyeability: 1.50) | 14.8 |
| Epoxy-modified silicone oil "SF8411" (Trademark) made by Dow Corning Toray Silicone Co., Ltd. | 0.07 |
| Isopropyl alcohol | 75.95 |

Thus, an image receiving sheet No. 17 according to the present invention was prepared.

Then, the sublimation thermal image transfer recording sheet A was superimposed on the image receiving sheet No. 17 in such a manner that the low-dyeable resin layer of the sublimation thermal image transfer recording sheet A came into contact with the overcoat layer of the image receiving sheet No. 17, and images were recorded on the overcoat layer of the image receiving sheet No. 17 by applying thermal energy imagewise to the sublimation thermal image transfer recording sheet A from the substrate side thereof using a thermal head, under the same conditions as in Example 1.

EXAMPLE 27

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 9.25 |
| Silicone graft copolymer resin "SP712" (Trademark) made by Dainichiseika Color and Chemicals Mfg. Co., Ltd. (Solvent: methyl ethyl ketone Solid content of resin: 12.5 wt. % Dyeability: 1.50) | 14.8 |
| Unmodified-silicone oil "SH200" (Trademark) made by Dow Corning Toray Silicone Co., Ltd. | 2.22 |
| Isopropyl alcohol | 75.95 |

Thus, an image receiving sheet No. 18 according to the present invention was prepared.

Then, the sublimation thermal image transfer recording sheet A was superimposed on the image receiving sheet No. 18 in such a manner that the low-dyeable resin layer of the sublimation thermal image transfer recording sheet A came into contact with the overcoat layer of the image receiving sheet No. 18, and images were recorded on the overcoat layer of the image receiving sheet No. 18 by applying thermal energy imagewise to the sublimation thermal image transfer recording sheet A from the substrate side thereof using a thermal head, under the same conditions as in Example 1.

EXAMPLE 28

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 9.25 |
| Silicone graft copolymer resin "SP712" (Trademark) made by Dainichiseika Color and Chemicals Mfg. Co., Ltd. (Solvent: methyl ethyl ketone Solid content of resin: 12.5 wt. % Dyeability: 1.50) | 14.8 |
| Epoxy modified-silicone oil "SF8411" (Trademark) made by Dow Corning Toray Silicone Co., Ltd. | 0.11 |
| Isopropyl alcohol | 75.95 |

Thus, an image receiving sheet No. 19 according to the present invention was prepared.

Then, the sublimation thermal image transfer recording sheet A was superimposed on the image receiving sheet No. 19 in such a manner that the low-dyeable resin layer of the sublimation thermal image transfer recording sheet A came into contact with the overcoat layer of the image receiving sheet No. 19, and images were recorded on the overcoat layer of the image receiving sheet No. 19 by applying thermal energy imagewise to the sublimation thermal image transfer recording sheet A from the substrate side thereof using a thermal head, under the same conditions as in Example 1.

EXAMPLE 29

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 9.25 |
| Silicone graft copolymer resin "SP712" (Trademark) made by Dainichiseika Color and Chemicals Mfg. Co., Ltd. (Solvent: methyl ethyl ketone Solid content of resin: 12.5 wt. % Dyeability: 1.50) | 14.8 |
| Unmodified-silicone oil "SH200" (Trademark) made by Dow Corning Toray Silicone Co., Ltd. | 0.95 |
| Isopropyl alcohol | 75.95 |

Thus, an image receiving sheet No. 2 according to the present invention was prepared.

Then, the sublimation thermal image transfer recording sheet A was superimposed on the image receiving sheet No. 20 in such a manner that the low-dyeable resin layer of the sublimation thermal image transfer recording sheet A came into contact with the overcoat layer of the image receiving sheet No. 20, and images were recorded on the overcoat layer of the image receiving sheet No. 20 by applying thermal energy imagewise to the sublimation thermal image transfer recording sheet A from the substrate side thereof using a thermal head, under the same conditions as in Example 1.

EXAMPLE 30

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene | 9.25 |

-continued

| | Parts by Weight |
|---|---|
| Solid content of resin: 20 wt. %) | |
| Silicone graft copolymer resin "SP712" (Trademark) made by Dainichiseika Color and Chemicals Mfg. Co., Ltd. (Solvent: methyl ethyl ketone Solid content of resin: 12.5 wt. % Dyeability: 1.50) | 14.8 |
| Epoxy modified-silicone oil "SF8411" (Trademark) made by Dow Corning Toray Silicone Co., Ltd. | 0.37 |
| Isopropyl alcohol | 75.95 |

Thus, an image receiving sheet No. 21 according to the present invention was prepared.

Then, the sublimation thermal image transfer recording sheet A was superimposed on the image receiving sheet No. 21 in such a manner that the low-dyeable resin layer of the sublimation thermal image transfer recording sheet A cane into contact with the overcoat layer of them image receiving sheet No. 21, and images were recorded on the overcoat layer of the image receiving sheet No. 21 by applying thermal energy imagewise to the sublimation thermal image transfer recording sheet A from the substrate side thereof using a thermal head, under the same conditions as in Example 1.

EXAMPLE 31

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Silicone resin "SR2411" (Trademark) made by Dow Corning Toray Silicone Co., Ltd. (Solvent: toluene Solid content of resin: 20 wt. %) | 9.25 |
| Silicone graft copolymer resin "SP712" (Trademark) made by Dainichiseika Color and Chemicals Mfg. Co., Ltd. (Solvent: methyl ethyl ketone Solid content of resin: 12.5 wt. % Dyeability: 1.50) | 14.8 |
| Epoxy modified-silicone oil "SF8411" (Trademark) made by Dow Corning Toray Silicone Co., Ltd. | 0.37 |
| Isopropyl alcohol | 37.97 |
| Toluene | 37.97 |

Thus, an image receiving sheet No. 22 according to the present invention was prepared.

Then, the sublimation thermal image transfer recording sheet A was superimposed on the image receiving sheet No. 22 in such a manner that the low-dyeable resin layer of the sublimation thermal image transfer recording sheet A came into contact with the overcoat layer of the image receiving sheet No. 22, and images were recorded on the overcoat layer of the image receiving sheet No 22 by applying thermal energy imagewise to the sublimation thermal image transfer recording sheet A from the substrate side thereof using a thermal head, under the same conditions as in Example 1.

COMPARATIVE EXAMPLE 3

The procedure for preparation of the image receiving sheet No. 1 in Example 1 was repeated except that the formulation for the overcoat layer coating liquid for use in the image receiving sheet No. 1 in Example 1 was changed to the following formulation:

| | Parts by Weight |
|---|---|
| Polyvinyl butyral resin "BX-1" (Trademark) made by Sekisui Chemical Co., Ltd. | 3.7 |
| Methyl ethyl ketone | 48.15 |
| Toluene | 48.15 |

Thus, a comparative image receiving sheet No. 3 was prepared.

Then, the sublimation thermal image transfer recording sheet A was superimposed on the comparative image receiving sheet No. 3 in such a manner that the low-dyeable resin layer of the sublimation thermal image transfer recording sheet A came into contact with the overcoat layer of the comparative image receiving sheet No. 3, and images were recorded on the overcoat layer of the comparative image receiving sheet No. 3 by applying thermal energy imagewise to the sublimation thermal image transfer recording sheet A from the substrate side thereof using a thermal head, under the same conditions as in Example 1.

COMPARATIVE EXAMPLE 4

The procedure for preparation of the image receiving sheet No. 1 in Example 1 was repeated except that the formulation for the overcoat layer coating liquid for use in the image receiving sheet No. 1 in Example 1 was changed to the following formulation;

| | Parts by Weight |
|---|---|
| Silicone resin "SR2411" (Trademark) made by Dow Corning Toray Silicone Co., Ltd. (Solvent: toluene Solid content of resin: 20 wt. %) | 18.5 |
| Isopropyl alcohol | 81.5 |

Thus, a comparative image receiving sheet No. 4 was prepared.

Then, the sublimation thermal image transfer recording sheet A was superimposed on the comparative image receiving sheet No. 4 in such a manner that the low-dyeable resin layer of the sublimation thermal image transfer recording sheet A came into contact with the overcoat layer of the comparative image receiving sheet No. 4, and images were recorded on the overcoat layer of the comparative image receiving sheet No. 4 by applying thermal energy imagewise to the sublimation thermal image transfer recording sheet A from the substrate side thereof using a thermal head, under the same conditions as in Example 1.

COMPARATIVE EXAMPLE 5

Preparation of Image-receiving Sheet

The following components were mixed to prepare a coating liquid for a dye-receiving layer:

| | Parts by Weight |
|---|---|
| Vinyl chloride-isobutyl vinyl ether copolymer "Laroflex" (Trademark) made by BASF Japan Ltd. | 9 |
| Alkyl trimellitate "Adeka Cizer" (Trademark) made by Asahi Denka Kogyo K.K. | 1 |
| Methyl ethyl ketone | 80 |
| Cyclohexanone | 10 |

The thus obtained dye-receiving layer coating liquid was coated on a sheet of commercially available synthetic paper with a thickness of 150 μm (Trademark "Yupo PG-150", made by Oji-Yuka Synthetic Paper Co., Ltd.), and dried, so that a dye-receiving layer with a thickness of 10 μm was provided on the substrate.

Formation of overcoat layer

The following components were mixed to prepare a coating liquid for an overcoat layer:

| | Parts by Weight |
|---|---|
| Polyvinyl chloride "TK600" (Trademark) made by Shin-Etsu Chemical Co., Ltd. | 9.5 |
| Polyester-modified silicone oil "X-24-8300" (Trademark) made by Shin-Etsu Silicone Co., Ltd. | 0.5 |
| Methyl ethyl ketone | 80 |
| Cyclohexanone | 10 |

The thus obtained overcoat layer coating liquid was coated on the dye-receiving layer and dried, so that an overcoat layer with a thickness of 2 μm was provided on the dye-receiving layer.

Thus, a comparative image-receiving sheet No. 5 was obtained.

Then, the sublimation thermal image transfer recording sheet A was superimposed on the comparative image receiving sheet No. 5 in such a manner that the low-dyeable resin layer of the sublimation thermal image transfer recording sheet A came into contact with the overcoat layer of the comparative image receiving sheet No. 5, and images were recorded on the overcoat layer of the comparative image receiving sheet No. 5 by applying thermal energy imagewise to the sublimation thermal image transfer recording sheet A from the substrate side thereof using a thermal head, under the same conditions as in Example 1.

EXAMPLE 32

Preparation of Sublimation Thermal Image Transfer Recording Sheet B

Formation of recording layer

The following components were mixed to prepare a coating liquid for a recording layer:

| | Parts by Weight |
|---|---|
| Polyvinyl butyral resin "BX-1" (Trademark) made by Sekisui Chemical Co., Ltd | 10 |
| Sublimable dye "R-1" (Trademark) made by Nippon Kayaku Co., Ltd. | 10 |
| Toluene | 95 |
| Methyl ehtyl ketone | 95 |

On one surface of a PET film with a thickness of 6 μm, bearing a 1-μm-thick heat-resistant silicone resin layer on the other surface thereof, the above prepared coating liquid for the recording layer was coated by a wire bar, and dried at 80° C. for 90 seconds.

Thus, a sublimation thermal image transfer recording sheet B for use in the present invention was prepared.

Preparation of Image-receiving Sheet

The following components were mixed to prepare a coating liquid for a dye-receiving layer:

| | Parts by Weight |
|---|---|
| Vinyl chloride-vinyl acetate-vinyl alcohol copolymer "Denka Vinyl #1000GKT" (Trademark) made by Denki Kagaku Kogyo K.K. | 9.4 |
| Toluene | 21.4 |
| Methyl ethyl ketone | 64.3 |

The thus obtained dye-receiving layer coating liquid was coated on a commercially available synthetic paper (Trademark "Yupo", made by Oji-Yuka Synthetic Paper Co., Ltd.), and dried at 80° C., so that a dye-receiving layer with a thickness of 5 μm was provided on the substrate.

Formation of overcoat layer

The following components were mixed to prepare a coating liquid for an overcoat layer:

| | Parts by Weight |
|---|---|
| Silicone graft copolymer resin "SP712" (Trademark) Dainichiseika Color and Chemicals Mfg. Co., Ltd. | 14.80 |
| Ultraviolet absorber "Sumisorb 100" (Trademark) made by Sumitomo Chemical Co., Ltd. | 0.02 |
| Isopropyl alcohol | 37.96 |
| Toluene | 37.96 |

The thus obtained overcoat layer coating liquid was coated on the dye-receiving layer and dried at 100° C., so that an overcoat layer with a thickness of 1.0 μm was provided on the dye-receiving layer.

Thus, an image-receiving sheet No. 23 for use in the present invention was obtained.

Then, the sublimation thermal image transfer recording sheet B was superimposed on the image receiving sheet No. 23 in such a manner that the recording layer of the sublimation thermal image transfer recording sheet B came into contact with the overcoat layer of the image receiving sheet No. 23, and images were recorded on the overcoat layer of the image receiving sheet No. 23 by applying thermal energy imagewise to the sublimation thermal image transfer recording sheet B from the substrate side thereof using a thermal head, under the following conditions:

Applied electric power: 0.13 W/dot

Recording density of thermal head: 12 dot/mm

Applied thermal energy: 0.41 mJ/dot (Transporting speed of image-receiving sheet)/(Transporting speed of recording sheet): 1

Thereafter, the sheet member (I) for heat treatment was superimposed on the image-bearing image receiving sheet No. 23 in such a manner that the low-dyeable resin layer of the sheet member (I) was in contact with the image-bearing surface of the image receiving sheet No. 23, and heat treatment was carried out by applying thermal energy thereto under the following conditions:

Recording density of thermal head: 12 dot/mm

Applied thermal energy: 0.37 mJ/dot (Transporting speed of image-receiving sheet)/(Transporting speed of sheet member for heat treatment): 1

COMPARATIVE EXAMPLE 6

The sublimation thermal image transfer recording sheet 8 was superimposed on the image receiving sheet No. 23 prepared in Example 32 in such a manner that the recording layer of the sublimation thermal image transfer recording sheet B came into contact with the overcoat layer of the image receiving sheet No. 23 and images were recorded on the overcoat layer of the image receiving sheet No. 23 by applying thermal energy imagewise to the sublimation thermal image transfer recording sheet B from the substrate side thereof using a thermal head, under the sane conditions as in Example 32.

Thereafter, the same sheet member (I) for heat treatment as employed in Example 32 was superimposed on the image-bearing image receiving sheet No. 23 in such a manner that the low-dyeable resin layer of the sheet member (I) was in contact with the image-bearing surface of the image receiving sheet No. 23, and heat treatment was carried out by applying thermal energy thereto under the same conditions as in Example 32 except that the applied thermal energy was changed from 0.37 to 0.50 mJ/dot.

COMPARATIVE EXAMPLE 7

The sublimation thermal image transfer recording sheet B was superimposed on the image receiving sheet No. 23 prepared in Example 32 in such a manner that the recording layer of the sublimation thermal image transfer recording sheet B came into contact with the overcoat layer of the image receiving sheet No. 23, and images were recorded on the overcoat layer of the image receiving sheet No. 23 by applying thermal energy imagewise to the sublimation thermal image transfer recording sheet B from the substrate side thereof using a thermal head, under the same conditions as in Example 32.

Thereafter, the same sheet member (I) for heat treatment as employed in Example 32 was superimposed on the image-bearing image receiving sheet No. 23 in such a manner that the low-dyeable resin layer of the sheet member (I) was in contact with the image-bearing surface of the image receiving sheet No. 23, and heat treatment was carried out by applying thermal energy thereto under the same conditions as in Example 32 except that the applied thermal energy was changed from 0.37 to 0.25 mJ/dot.

The following evaluation tests were conducted in Examples 4 to 12 and 32 and Comparative Examples 6 and 7 in order to examine the improvement of image quality by subjecting the image-bearing image receiving sheet to the heat treatment according to the present invention.

[1] Glossiness of recorded image

The specular glossiness of the recorded image was measured at an angle of 60° using a commercially available glossmeter (Trademark "PG-3", made by Nippon Denshoku Kogyo Co., Ltd.) after the image-bearing image receiving sheet was subjected to heat treatment.

The glossiness of the recorded image was evaluated on the following scale:

○: 60% or more.

Δ: 60%>glossiness≧45%.

x: glossiness<45%.

The results are shown in Table 1.

[2] Curling of image-bearing image receiving sheet

After the image-bearing image receiving sheet was subjected to heat treatment; it was visually observed whether the image-bearing image receiving sheet was curled or not.

The results are shown in Table 1.

[3] Dynamic friction coefficient of overcoat layer for use in image receiving sheet The dynamic friction coefficient of the overcoat layer for use in the image receiving sheet was measured by the method as previously mentioned.

The results are shown in Table 1.

[4] Anti-sticking performance

When images were transferred from the sublimation thermal image transfer recording sheet to the image receiving sheet in the 12-times-speed mode, the condition of the adhesion of the thermal image transfer recording sheet to the image receiving sheet was visually evaluated in accordance with the following scale:

○: There was no sticking problem.

Δ: A fused portion of the sublimation thermal image transfer recording sheet partially stuck to the image receiving sheet.

x: The adhesion and sticking of the sublimation thermal image transfer recording sheet to the image receiving sheet was entirely observed.

The results are shown in Table 1.

[5] Light resistance

The dye image with an image density of 1.0 recorded on the image receiving sheet was exposed to light of 150,000 lux for 72 hours using a xenon fadeometer.

Then, the image density preservation ratio (%) was calculated in accordance with the following formula:

$$\text{Image density preservation ratio (\%)} = \frac{\text{Image density after light exposure}}{\text{Image density before light exposure}} \times 100$$

The results are shown in Table 1.

[6] Plasticizer resistance

Three laminated polymeric wraps (made by Shin-Etsu Polymer Co., Ltd.) were placed on the image receiving sheet bearing a dye image with an image density of 1.0 under the application of a load of 3 kg. Under such conditions, the image-bearing image receiving sheet was allowed to stand at 40° C. for 24 hours, Then, the image density preservation ratio (%) was calculated in accordance with the following formula:

$$\text{Image density preservation ratio (\%)} = \frac{\text{Image density after storage}}{\text{Image density before storage}} \times 100$$

The plasticizer resistance of the image recorded on the image receiving sheet was evaluated on the following scale:

⊚: image density preservation ratio≧90%.

○: 90%>image density preservation ratio≧75%.

Δ: 75%>image density preservation ratio≧60%.

x: image density preservation ratio<60%.

The results are shown in Table 1.

[7] Image density

The dye image recorded on the image receiving sheet was measured using McBeth densitometer of reflection type RD-918.

The results are shown in Table 1.

[8] Preservation stability of recorded image

The image receiving sheet bearing an image with an image density of 1.0 was allowed to stand in the dark at 60° C. for 30 days.

Then, the image density preservation ratio (%) was calculated in accordance with the following formula:

$$\text{Image density preservation ratio (\%)} = \frac{\text{Image density after storage}}{\text{Image density before storage}} \times 100$$

The preservation stability of the image recorded on the image receiving sheet was evaluated on the following scale:

⊚: image density preservation ratio≧90%.

○: 90%>image density preservation ratio≧75%.

Δ: 75%>image density preservation ratio≧60%.

x: image density preservation ratio<60%.

The results are shown in Table 1.

TABLE 1

| | Glossiness of Recorded image | Curling of Image Receiving Sheet | Friction Coefficient | Anti-sticking Performance | Light Resistance (%) | Plasticizer Resistance | Image Density | Preservation Stability of Recorded Image |
|---|---|---|---|---|---|---|---|---|
| Ex. 4 | 50% | none | 0.20 | ○ | 55 | ○ | 2.04 | ⊚ |
| Ex. 5 | 55% | none | 0.20 | ○ | 69 | ⊚ | 2.04 | ⊚ |
| Ex. 6 | 60% or more | none | 0.20 | ○ | 70 | ⊚ | 2.04 | ⊚ |
| Ex. 7 | 50% | none | 0.20 | ○ | 56 | ○ | 2.04 | ⊚ |
| Ex. 8 | 60% or more | none | 0.20 | ○ | 67 | ⊚ | 2.04 | ⊚ |
| Ex. 9 | 60% or more | none | 0.20 | ○ | 72 | ⊚ | 2.04 | ⊚ |
| Ex. 10 | 60% or more | none | 0.20 | ○ | 76 | ⊚ | 2.04 | ⊚ |
| Ex. 11 | 60% or more | none | 0.20 | ○ | 70 | ⊚ | 2.04 | ⊚ |
| Ex. 12 | 60% or more | none | 0.21 | ○ | 81 | ⊚ | 2.06 | ⊚ |
| Ex. 32 | 40% | none | — (**) | X | 70 | ⊚ | 2.00 | ○ |
| Comp. Ex. 6 | 8% (*) | considerable curling | — (**) | X | 77 | ⊚ | 2.00 | ○ |
| Comp. Ex. 7 | 40% | none | — (**) | X | 50 | Δ | 2.00 | ○ |

(*) The overcoat layer of the image receiving sheet was scorched by the heat treatment.
(**) It was impossible to measure the dynamic friction coefficient because the overcoat layer of the image receiving sheet was fused and attached to the aromatic polyamide film at 100° C.

Furthermore, the image receiving sheet according to the present invention of which overcoat layer has a dynamic friction coefficient of less than 0.45 was compared with the comparative image receiving sheet. The results are shown in Table 2.

Each evaluation item was measured in the same manner as in Table 1.

In addition to the above, the blocking resistance was evaluated in such a manner that the image receiving sheet was attached to a PET film with the application of a load of 3 kg thereto and the image receiving sheet and the PET film were allowed to stand for 24 hours. After the storage, the blocking condition between the image receiving sheet and the PET film was visually observed.

The results are shown in Table 2.

TABLE 2

| | Dynamic Friction Coefficient of Overcoat Layer | Anti-sticking Performance | Light Resistance (%) | Plasticizer Resistance | Image Density | Preservation Stability of Recorded Image | Remarks |
|---|---|---|---|---|---|---|---|
| Ex. 1 | 0.20 | ○ | 52 | Δ | 2.04 | ○ | |
| Ex. 2 | 0.21 | ○ | 65 | Δ | 2.06 | ○ | |
| Ex. 3 | 0.22 | ○ | 71 | Δ | 2.07 | ○ | The overcoat layer of the image receiving sheet became yellowish because of the ultraviolet absorber. |
| Ex. 13 | 0.20 | ○ | 52 | Δ | 1.68 | ○ | There was partial omission in the recorded image. |
| Ex. 14 | 0.20 | ○ | 52 | Δ | 1.85 | ○ | |
| Ex. 15 | 0.20 | ○ | 52 | Δ | 2.10 | ○ | |
| Ex. 16 | 0.21 | ○ | 65 | Δ | 2.10 | ○ | |
| Ex. 17 | 0.21 | ○ | 65 | Δ | 2.09 | ○ | |
| Ex. 18 | 0.21 | ○ | 65 | Δ | 2.08 | ○ | |
| Ex. 19 | 0.19 | ○ | 41 | Δ | 2.05 | ○ | |
| Ex. 20 | 0.38 | Δ | 41 | Δ | 1.05 | X | |
| Ex. 21 | 0.35 | Δ | 42 | Δ | 1.22 | X | |
| Ex. 22 | 0.32 | Δ | 41 | Δ | 1.45 | X | |
| Ex. 23 | 0.30 | Δ | 49 | Δ | 1.60 | Δ | |
| Ex. 24 | 0.30 | Δ | 51 | Δ | 2.05 | ○ | |
| Ex. 25 | 0.28 | ○ | 52 | Δ | 2.02 | ○ | There was unevenness in recorded images because of the silicone oil not soluble in the overcoat layer of the image receiving sheet. |
| Ex. 26 | 0.25 | ○ | 51 | Δ | 2.10 | ○ | There was unevenness in recorded images because of the silicone oil not soluble in the overcoat layer of the image receiving sheet. |
| Ex. 27 | 0.24 | ○ | 51 | Δ | 2.06 | ○ | There was unevenness in recorded images because of the silicone oil not soluble in the overcoat layer of the image receiving sheet. The blocking phenomenon was noticeable because of a large amount of silicone oil. |
| Ex. 28 | 0.23 | ○ | 53 | Δ | 2.08 | ○ | There was unevenness in recorded images because of the silicone oil not soluble in the overcoat layer of the image receiving sheet. |
| Ex. 29 | 0.22 | ○ | 52 | Δ | 2.08 | ○ | There was unevenness in recorded images because of the silicone oil not soluble in the overcoat layer of the image receiving sheet. |
| Ex. 30 | 0.19 | ○ | 50 | Δ | 2.02 | ○ | There was unevenness in recorded images because of the silicone oil not soluble in the overcoat layer of the image receiving sheet. Slight blocking phenomenon occurred because of a large amount of silicone oil. |

TABLE 2-continued

| | Dynamic Friction Coefficient of Overcoat Layer | Anti-sticking Performance | Light Resistance (%) | Plasticizer Resistance | Image Density | Preservation Stability of Recorded Image | Remarks |
|---|---|---|---|---|---|---|---|
| Ex. 31 | 0.19 | ○ | 51 | Δ | 2.05 | ○ | |
| Comp. Ex. 1 | 0.75 | X | 39 | Δ | 2.06 | ○ | equal speed (n = 1) mode (**) |
| Comp. Ex. 2 | — (*) | X | 45 | Δ | 2.12 | ○ | 2-times-speed (n = 2) mode (**) |
| Comp. Ex. 3 | — (*) | X | 54 | X | 2.05 | ○ | 3-times-speed (n = 3) mode (**) |
| Comp. Ex. 4 | 0.48 | X | 37 | Δ | 1.02 | X | 4-times-speed (n = 4) mode (**) |
| Comp. Ex. 5 | — (*) | X | 41 | X | 1.75 | X | equal speed (n = 1) mode (**) |

(*) It was impossible to measure the dynamic friction coefficient because the overcoat layer of the image receiving sheet was fused and attached to the aromatic polyamide film at 100° C.
(**) The ratio (n) of the transporting speed of image receiving sheet to that of the recording sheet was changed because it was impossible to carry out the image recording by the 12-times-speed (n = 12) mode.

As can be seen from the results shown in Tables 1 and 2, when the sublimation thermal image transfer recording is carried out by the method of the present invention, and using an image receiving sheet of the present invention, the sublimation thermal image transfer recording sheet does not stick to the image receiving sheet during the image transfer recording by the n-times-speed mode. As a result, the image receiving sheet can be prevented from being damaged, and the ink images can be normally recorded on the image receiving sheet. Furthermore, the images recorded on the image receiving sheet do not deteriorate while stored for an extended period of time, so that high image density can be maintained.

What is claimed is:

1. A sublimation thermal image transfer recording method for thermally forming images on an image receiving sheet which comprises a substrate and a dye-receiving layer formed thereon, comprising the steps of:

superimposing (a) a sublimation thermal image transfer recording sheet comprising a substrate and at least one recording layer provided on said substrate, comprising an ink area which comprises a sublimable dye, on (b) said image receiving sheet, in such a manner that said recording layer of said sublimation thermal image transfer recording sheet comes into contact with said dye-receiving layer of said image receiving sheet, recording images on said dye-receiving layer of said image receiving sheet by applying thermal energy Ei imagewise to said sublimation thermal image transfer recording sheet from the side of said substrate of said sublimation thermal image transfer recording sheet using a thermal head, thereby forming an image-bearing image receiving sheet, and subjecting said image-bearing image receiving sheet to heat treatment by applying thermal energy Eb to said dye-receiving layer of said image receiving sheet using said thermal head, through a sheet member for heat treatment, said thermal energy Eb being smaller than said thermal energy Ei for image transfer recording.

2. The recording method as claimed in claim 1, wherein said thermal energy Ei for image transfer recording and said thermal energy Eb for heat treatment are in the relationship of Ei>Eb>0.8 Ei.

3. The recording method as claimed in claim 1, wherein said sheet member for heat treatment has a heating area which is shorter in the transporting direction thereof than the length of an image area recorded on said image receiving sheet in the transporting direction thereof.

4. The recording method as claimed in claim 1, wherein said sheet member for heat treatment comprises a surface layer comprising a resin with low dyeability.

5. The recording method as claimed in claim 1, wherein said recording layer of said sublimation thermal image transfer recording sheet further comprises an area free of said sublimable dye, and said area is used as said sheet member for heat treatment.

6. The recording method as claimed in claim 5, wherein said sublimable-dye-free area comprises a surface layer comprising a resin with low dyeability.

7. The recording method as claimed in claim 1, wherein said heat treatment step is carried out by moving said sublimation thermal image transfer recording sheet with a speed of 1/n (n>1) relative to said image receiving sheet with a speed of 1, and said recording layer of said sublimation thermal image transfer recording sheet further comprises an area free of said sublimable dye which is used as said sheet member for heat treatment, and said sublimable-dye-free area has a length b and said ink area has a length i in the transporting direction of said sublimation thermal image transfer recording sheet, with said lengths b and i being in the relationship of b<i.

8. An image receiving sheet for use with sublimation thermal image transfer recording, comprising a substrate, a dye-receiving layer formed on said substrate, and an overcoat layer formed on said dye-receiving layer, said overcoat layer having a coefficient of dynamic friction of less than 0.45 which is measured in accordance with ASTM-D1894 and comprising a silicone resin and a lubricant.

9. The image receiving sheet as claimed in claim 8, wherein said silicone resin is contained in said overcoat layer in an amount of less than 85 wt. % of the total weight of said overcoat layer.

10. The image receiving sheet as claimed in claim 8, wherein said overcoat layer has a thickness of 2 μm or less.

11. The image receiving sheet as claimed in claim 8, wherein said lubricant comprises a silicone graft copolymer.

12. The image receiving sheet as claimed in claim 11, wherein said silicone graft copolymer comprises a dyeable resin which constitutes a main backbone chain thereof.

13. The image receiving sheet as claimed in claim 8, wherein said overcoat layer further comprises a silicone oil.

14. The image receiving sheet as claimed in claim 13, wherein said silicone oil comprises at least one silicone oil component selected from the group consisting of an epoxy-modified silicone oil and an unmodified silicone oil.

15. The image receiving sheet as claimed in claim 13, wherein said silicone oil is contained in said overcoat layer in an amount of 3 to 50 wt. % of the total weight of resin components for use in said overcoat layer.

16. The image receiving sheet as claimed in claim 15, wherein said silicone oil is contained in said overcoat layer in an amount of 5 to 15 wt. % of the total weight of resin components for use in said overcoat layer.

17. The image receiving sheet as claimed in claim 13, wherein said overcoat layer is provided on said dye-receiving layer using a coating liquid for said overcoat layer which comprises said silicone resin, said lubricant, said silicone oil, and a solvent which comprises a solvent component compatible with said silicone oil, said solvent component being in an amount of 25 wt. % or more of the total weight of said solvent for use in said coating liquid.

18. The image receiving sheet as claimed in claim 8, wherein said overcoat layer further comprises an ultraviolet absorber.

19. The image receiving sheet as claimed in claim 18, wherein said ultraviolet absorber is contained in said overcoat layer in an amount of 1 to 50 wt. % of the total weight of resin components for use in said overcoat layer.

20. The image receiving sheet as claimed in claim 8, wherein said substrate is a laminated member comprising a sheet of paper and a cushioning layer formed thereon.

21. The image receiving sheet as claimed in claim 20, wherein said cushioning layer is a void-containing plastic film, the ratio of the density D of said void-containing plastic film to the density Do of a corresponding void-free plastic film being 0.7 or less.

22. The image receiving sheet as claimed in claim 6, further comprising a polyethylene layer which is provided on the back side of said substrate, opposite to said dye-receiving layer with respect to said substrate.

23. The image receiving sheet as claimed in claim 8, wherein said substrate is in the form of a card.

24. A sublimation thermal image transfer recording method for thermally farming images on an image receiving sheet which comprises a substrate, a dye-receiving layer formed on said substrate, and an overcoat layer formed on said dye-receiving layer, said overcoat layer having a coefficient of dynamic friction of less than 0.45 which is measured in accordance with ASTM-D1894 and comprising a silicone resin and a lubricant, comprising the steps of:

superimposing (a) a sublimation thermal image transfer recording sheet comprising a substrate and at least one recording layer provided on said substrate, comprising an ink area which comprises a sublimable dye, on (b) said image receiving sheet, in such a manner that said recording layer of said sublimation thermal image transfer recording sheet comes into contact with said overcoat layer of said image receiving sheet, recording images on said overcoat layer of said image receiving sheet by applying thermal energy Ei image-wise to said sublimation thermal image transfer recording sheet from the side of said substrate of said sublimation thermal image transfer recording sheet using a thermal head, thereby forming an image-bearing image receiving sheet, and subjecting said image-bearing image receiving sheet to heat treatment by applying thermal energy Eb to said overcoat layer of said image receiving sheet using said thermal head, through a sheet member for heat treatment, said thermal energy Eb being smaller than said thermal energy Ei for image transfer recording.

* * * * *